US011421682B2

(12) United States Patent
Byrne et al.

(10) Patent No.: US 11,421,682 B2
(45) Date of Patent: Aug. 23, 2022

(54) RECIPROCATING PUMP WITH DUAL CIRCUIT POWER END LUBRICATION SYSTEM

(71) Applicant: SPM Oil & Gas Inc., Fort Worth, TX (US)

(72) Inventors: Joseph H. Byrne, Hudson Oaks, TX (US); Edward C. Kotapish, Willow Park, TX (US); Scott Skurdalsvold, Mansfield, TX (US); Jacob A. Bayyouk, Richardson, TX (US); Lawrence Waweru, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 0 days.

(21) Appl. No.: 16/425,523

(22) Filed: May 29, 2019

(65) Prior Publication Data

US 2019/0277279 A1 Sep. 12, 2019

Related U.S. Application Data

(63) Continuation of application No. 14/808,726, filed on Jul. 24, 2015, now Pat. No. 10,352,321.

(Continued)

(51) Int. Cl.

| | |
|---|---|
| ***F04B 53/18*** | (2006.01) |
| ***F04B 1/0404*** | (2020.01) |
| *F04C 11/00* | (2006.01) |

(52) U.S. Cl.

CPC ..... *F04B 53/18* (2013.01); *F04B 1/0404* (2013.01); *F04C 11/005* (2013.01)

(58) Field of Classification Search

CPC ..... F04B 53/18; F04B 53/10; F04B 1/0404; F04C 11/005

(Continued)

(56) References Cited

U.S. PATENT DOCUMENTS

| | | |
|---|---|---|
| 364,627 A | 6/1887 | Arnold |
| 879,560 A | 2/1908 | Lepley |

(Continued)

FOREIGN PATENT DOCUMENTS

| | | |
|---|---|---|
| BR | 8700642 | 8/1988 |
| CA | 2486126 | 10/2005 |

(Continued)

OTHER PUBLICATIONS

Canadian Office Action dated Jul. 12, 2019 in Application No. 2,955,673, 9 pages.

(Continued)

*Primary Examiner* — Michael R Mansen
*Assistant Examiner* — Mark K Buse
(74) *Attorney, Agent, or Firm* — Foley & Lardner LLP

(57) ABSTRACT

A dual circuit lubrication system for a power end of a reciprocating pump that includes a lubrication pump that supplies lubrication fluid to a high pressure lubrication circuit and a low pressure lubrication circuit. The high pressure lubrication circuit is fluidly coupled to a crankshaft to supply lubrication fluid to journal surfaces associated with the crankshaft at a first lubrication fluid pressure. The crankshaft drives a crosshead coupled to a plunger to displace fluid from a fluid end of the reciprocating pump. The low pressure lubrication circuit is fluidly coupled to supply the lubrication fluid to a plurality of roller bearing surfaces associated with the crankshaft at a second lubrication fluid pressure. The first lubrication fluid pressure is greater than the second lubrication fluid pressure.

21 Claims, 8 Drawing Sheets

Related U.S. Application Data

(60) Provisional application No. 62/099,377, filed on Jan. 2, 2015, provisional application No. 62/095,650, filed on Dec. 22, 2014.

(58) Field of Classification Search
USPC ..... 184/6.28
See application file for complete search history.

(56) References Cited

U.S. PATENT DOCUMENTS 1,490,294 A 4/1924 Steffen
1,596,037 A 8/1926 Warner
1,707,228 A 4/1929 Knapp
1,890,428 A 12/1932 Ferris et al.
1,893,699 A 1/1933 Dunning
1,899,743 A * 2/1933 Berry ..... F01L 5/02 123/188.4
1,926,925 A 9/1933 Wescott
2,249,802 A 7/1941 Hart
2,443,332 A 6/1948 Summers
2,461,056 A 2/1949 Hess
2,561,227 A 7/1951 Reed
2,682,433 A 6/1954 Maier
2,729,117 A 1/1956 Maybach
2,755,739 A 7/1956 Euwe
2,766,701 A 10/1956 Giraudeau
2,823,085 A 2/1958 Keylwert
2,828,931 A 4/1958 Harvey
2,878,990 A 3/1959 Zurcher
2,883,874 A 4/1959 Bynum
2,899,247 A 8/1959 Clarkson
3,039,317 A 6/1962 Wilson
3,049,082 A 8/1962 Barry
3,053,195 A 9/1962 Williamson
3,158,211 A 11/1964 McCue et al.
3,179,451 A 4/1965 Blank
3,206,242 A 9/1965 Fensin
3,207,142 A 9/1965 Gorissen et al.
3,236,315 A 2/1966 Lora
3,238,892 A 3/1966 Coberly
3,356,036 A 12/1967 Repp
3,358,352 A 12/1967 Wilcox
3,487,892 A 1/1970 Kiefer
3,583,052 A 6/1971 Herbenar et al.
3,595,101 A 7/1971 Cooper, Sr.
3,656,582 A * 4/1972 Alcock ..... F16C 5/00 184/6.5
3,760,694 A 9/1973 Lieb
3,880,604 A 4/1975 Hawkins
3,883,941 A 5/1975 Coil
3,967,542 A 7/1976 Hall et al.
4,048,909 A 9/1977 Jepsen
4,099,447 A 7/1978 Ogles
4,191,238 A 3/1980 Pichl
4,209,079 A 6/1980 Marchal et al.
4,210,399 A 7/1980 Jain
4,211,190 A 7/1980 Indech
4,269,569 A 5/1981 Hoover
4,338,054 A 7/1982 Dahl
4,388,837 A 6/1983 Bender
4,477,237 A 10/1984 Grable
4,494,415 A 1/1985 Elliston
4,512,694 A 4/1985 Foran et al.
4,553,298 A 11/1985 Grable
4,729,249 A 3/1988 Besic
4,771,801 A 9/1988 Crump et al.
4,809,646 A 3/1989 Paul et al.
4,824,342 A 4/1989 Buck
4,876,947 A 10/1989 Rhodes
4,887,518 A 12/1989 Hayakawa
4,950,145 A 8/1990 Zanetos et al.
5,033,177 A 7/1991 Gathright et al.
5,060,603 A 10/1991 Williams
5,062,311 A 11/1991 Bennitt
5,076,220 A 12/1991 Evans et al.
5,080,319 A 1/1992 Nielsen
5,115,725 A 5/1992 Horiuchi
5,159,743 A 11/1992 Somerville
5,165,160 A 11/1992 Poncelet
5,247,873 A 9/1993 Owens et al.
5,425,306 A 6/1995 Binford
5,594,665 A 1/1997 Walter et al.
5,658,250 A 8/1997 Blomquist et al.
5,671,655 A 9/1997 Vollrath
5,673,666 A 10/1997 Beardmore et al.
5,682,851 A * 11/1997 Breen ..... F01M 9/108 123/196 A
5,772,403 A 6/1998 Allison et al.
5,855,397 A 1/1999 Black et al.
5,984,645 A 11/1999 Cummings
6,330,525 B1 12/2001 Hays et al.
6,419,459 B1 7/2002 Sibbing
6,581,261 B1 6/2003 Chen
6,663,349 B1 12/2003 Discenzo et al.
6,697,741 B2 2/2004 Yu et al.
6,718,955 B1 4/2004 Knight
D495,342 S 8/2004 Tojo et al.
D496,670 S 9/2004 Ohnishi
6,859,740 B2 2/2005 Stephenson et al.
6,873,267 B1 3/2005 Tubel et al.
6,882,960 B2 4/2005 Miller
7,044,216 B2 5/2006 Otten et al.
7,111,604 B1 9/2006 Hellenbroich et al.
D538,824 S 3/2007 Tojo
7,219,594 B2 5/2007 Kugelev et al.
7,220,119 B1 5/2007 Kirchmer et al.
7,272,533 B2 9/2007 Schlosser
7,364,412 B2 4/2008 Kugelev et al.
D591,311 S 4/2009 Tojo
7,621,179 B2 11/2009 Ens et al.
8,162,631 B2 4/2012 Patel et al.
D658,684 S 5/2012 Roman
D668,266 S 10/2012 Ramirez, Jr.
D670,312 S 11/2012 Alexander et al.
D676,875 S 2/2013 Ramirez, Jr.
8,376,432 B1 2/2013 Hagler et al.
D678,911 S 3/2013 Prevost
D685,393 S 7/2013 Prevost
8,529,230 B1 9/2013 Colley, III et al.
D692,026 S 10/2013 Alexander et al.
8,561,760 B2 * 10/2013 Yoshikawa ..... F16H 61/0021 184/6
8,707,853 B1 4/2014 Dille et al.
D704,385 S 5/2014 Hoofman
D708,401 S 7/2014 Krueger
D713,101 S 9/2014 Bruno et al.
8,833,301 B2 9/2014 Donegan et al.
8,833,302 B2 9/2014 Donegan et al.
9,004,033 B2 4/2015 Flender et al.
9,121,402 B2 9/2015 Marshall et al.
9,188,123 B2 11/2015 Hubenschmidt et al.
D759,728 S 6/2016 Byrne et al.
10,520,037 B2 12/2019 Kumar et al.
10,526,862 B2 1/2020 Witkowski et al.
2002/0046905 A1 * 4/2002 Hulkkonen ..... D21G 1/022 184/6.1
2002/0189587 A1 12/2002 Hirano
2003/0024386 A1 2/2003 Burke
2004/0219040 A1 11/2004 Kugelev et al.
2004/0244577 A1 12/2004 Haughom
2005/0092500 A1 5/2005 Otten et al.
2006/0029502 A1 2/2006 Kugelev et al.
2007/0041849 A1 * 2/2007 Allen ..... F04B 9/02 417/273
2007/0131839 A1 6/2007 Dunn et al.
2007/0144842 A1 6/2007 Zhou
2008/0006148 A1 1/2008 McKelroy
2008/0080992 A1 4/2008 Cummins
2008/0187409 A1 8/2008 Bodin et al.
2008/0213115 A1 9/2008 Hilger et al.
2009/0236573 A1 9/2009 Hu
2010/0129245 A1 5/2010 Patel et al.
2010/0160710 A1 6/2010 Strickland

(56) References Cited

U.S. PATENT DOCUMENTS

| | | | | |
|---|---|---|---|---|
| 2010/0172778 | A1 | 7/2010 | Kugelev et al. | |
| 2010/0242720 | A1* | 9/2010 | Matzner | F16C 5/00 92/139 |
| 2010/0322802 | A1* | 12/2010 | Kugelev | F04B 53/147 417/437 |
| 2011/0081268 | A1 | 4/2011 | Ochoa et al. | |
| 2012/0017631 | A1 | 1/2012 | Brenneis et al. | |
| 2012/0074631 | A1 | 3/2012 | Dagenais | |
| 2012/0144995 | A1* | 6/2012 | Bayyouk | F04B 27/00 91/472 |
| 2012/0148430 | A1 | 6/2012 | Hubenschmidt et al. | |
| 2012/0167759 | A1 | 7/2012 | Chinthan et al. | |
| 2012/0213651 | A1 | 8/2012 | Ochoa et al. | |
| 2012/0272764 | A1 | 11/2012 | Pendleton | |
| 2013/0064696 | A1 | 3/2013 | McCormick et al. | |
| 2013/0112074 | A1 | 5/2013 | Small | |
| 2013/0145591 | A1 | 6/2013 | Chen | |
| 2013/0195701 | A1* | 8/2013 | Skurdalsvold | F04B 53/16 417/521 |
| 2013/0206108 | A1 | 8/2013 | Schule et al. | |
| 2013/0264761 | A1 | 10/2013 | Dagenais | |
| 2014/0013769 | A1 | 1/2014 | Martin et al. | |
| 2014/0147291 | A1* | 5/2014 | Burnette | F04B 53/14 417/53 |
| 2014/0196570 | A1 | 7/2014 | Small et al. | |
| 2014/0322050 | A1* | 10/2014 | Marette | F04B 47/02 417/437 |
| 2015/0101694 | A1 | 4/2015 | Forrest et al. | |
| 2015/0377318 | A1 | 12/2015 | Byrne | |
| 2016/0025082 | A1 | 1/2016 | Byrne et al. | |
| 2016/0025088 | A1 | 1/2016 | Byrne et al. | |
| 2016/0025089 | A1 | 1/2016 | Kumar et al. | |
| 2016/0025090 | A1 | 1/2016 | Bayyouk et al. | |
| 2017/0211565 | A1 | 7/2017 | Morreale | |
| 2018/0045187 | A1 | 2/2018 | Nagel et al. | |

FOREIGN PATENT DOCUMENTS

| | | | |
|---|---|---|---|
| CA | 2686204 | | 5/2010 |
| CA | 2749110 | | 7/2010 |
| CA | 153846 | | 9/2014 |
| CN | 2436688 | | 6/2001 |
| CN | 2705626 | | 6/2005 |
| CN | 1908435 | A | 2/2007 |
| CN | 2926584 | | 7/2007 |
| CN | 101012821 | A | 8/2007 |
| CN | 200964929 | | 10/2007 |
| CN | 201092955 | | 7/2008 |
| CN | 101356399 | A | 1/2009 |
| CN | 101476558 | | 7/2009 |
| CN | 201836038 | | 5/2011 |
| CN | 201874803 | | 6/2011 |
| CN | 201961961 | U | 9/2011 |
| CN | 102371537 | A | 3/2012 |
| CN | 102374159 | A | 3/2012 |
| CN | 2021 86832 | | 4/2012 |
| CN | 202187877 | U | 4/2012 |
| CN | 102439314 | | 5/2012 |
| CN | 102652223 | A | 8/2012 |
| CN | 202493418 | U | 10/2012 |
| CN | 202527901 | U | 11/2012 |
| CN | 202707463 | U | 1/2013 |
| CN | 102959244 | A | 3/2013 |
| CN | 203067205 | U | 7/2013 |
| CN | 103403351 | | 11/2013 |
| CN | 2009100265839 | | 4/2014 |
| CN | ZL201330555622.7 | | 5/2014 |
| CN | 103850908 | A | 6/2014 |
| CN | 104204519 | A | 12/2014 |
| CN | 104355227 | A | 2/2015 |
| CN | 105264275 | A | 1/2016 |
| CN | 106687688 | A | 5/2017 |
| CN | 106937530 | A | 7/2017 |
| DE | 11 91 069 | | 4/1965 |
| DE | 34 41 508 | | 5/1986 |
| DE | 38 02 714 | | 8/1988 |
| DE | 10 2007 028 446 | A1 | 12/2008 |
| EP | 0 300 905 | | 1/1989 |
| EP | 1 640 571 | A1 | 3/2006 |
| EP | 2 397 694 | A1 | 12/2011 |
| EP | 2 626 525 | A1 | 8/2013 |
| FR | 2618509 | | 1/1989 |
| GB | 0 204 454 | A | 10/1923 |
| GB | 2 419 671 | | 5/2006 |
| GB | 2 482 786 | | 2/2012 |
| JP | 60175753 | | 9/1985 |
| JP | 4-356344 | A | 12/1992 |
| JP | 40-7208479 | A | 8/1995 |
| JP | 10288086 | | 10/1998 |
| JP | 2920004 | | 7/1999 |
| JP | 11200947 | | 7/1999 |
| JP | 3974386 | | 9/2007 |
| JP | 2008539364 | | 11/2008 |
| JP | 2012002225 | | 1/2012 |
| KP | 19990079544 | | 11/1999 |
| KP | 100287572 | | 6/2001 |
| KR | 1019990060438 | | 7/1999 |
| KR | 100275877 | | 12/2000 |
| KR | 20010065249 | | 7/2001 |
| KR | 100302886 | | 11/2001 |
| KR | 10200170108223 | | 12/2001 |
| RU | 2037700 | | 6/1995 |
| SG | 20131413 | | 3/2014 |
| WO | WO-2005/061936 | A1 | 7/2005 |
| WO | WO-2008/137515 | | 11/2008 |
| WO | WO-2010/080961 | | 7/2010 |
| WO | WO-2010/080963 | | 7/2010 |
| WO | WO-2011/005571 | | 1/2011 |
| WO | WO-2012/038623 | | 3/2012 |
| WO | WO-2012/092452 | | 7/2012 |
| WO | WO-2013/183990 | | 12/2013 |
| WO | WO-2014/143094 | | 9/2014 |
| WO | WO-201 6/015012 | | 1/2016 |
| WO | WO-2016/014967 | | 1/2016 |
| WO | WO-2016/014988 | | 1/2016 |
| WO | WO-2016/015006 | | 1/2016 |
| WO | WO-2016/015012 | | 1/2016 |

OTHER PUBLICATIONS

European Examination Report dated Dec. 2, 2019 for European Patent Application No. EP 15824854.2, 4 pages.

Canadian Examination Report for Canadian Patent Application No. 3,031,128 dated Jan. 22, 2020.

"Metaldyne, Torsional Vibration Dampers, Brochure."

"Simatool Bearing Handling Tool BHT," Simatec Smart Technologies; Dec. 19, 2013; http://www.simatec.com/products/simatool/bearinghandlingtool/.

Advisory Action dated Apr. 7, 2009, by the USPTO, re U.S. Appl. No. 10/833,921.

Advisory Action dated Jul. 17, 2018, by the USPTO, re U.S. Appl. No. 14/808,513, 4 pages.

Advisory Action dated Sep. 15, 2017, by the USPTO, re U.S. Appl. No. 14/808,581, 2 pages.

Australia Exam Report, dated Feb. 9, 2015, by IP Australia, re App No. 2011352095.

Australian Office Action dated Dec. 20, 2018 in Application No. 2018200077, 4 pages.

Canada Office Action dated Sep. 21, 2018 in Application No. 2,955,673; 4 pages.

Canadian Examiner's Report dated Apr. 12, 2018, by the CIPO, re App. No. 2,972,031, 4 pages.

Canadian Examiner's Report dated Aug. 18, 2016, by the CIPO, re App No. 2905809.

Canadian Examiner's Report dated Jan. 11, 2016, by the CIPO, re App No. 2749110.

Canadian Examiner's Report, dated Oct. 22, 2015, by the CIPO, re App No. 2686204.

Canadian Examiner's Report, dated May 13, 2014, by the CIPO, re App No. 153846.

(56) References Cited

OTHER PUBLICATIONS

Canadian Examiner's Report, dated Oct. 8, 2014, by the CIPO, re App No. 2823213.
Canadian Office Action dated Jul. 12, 2018, by the CIPO, re App. No. 2,955,814, 9 pages.
Canadian Office Action dated May 17, 2011, re App No. 2486126.
Chinese Office Action dated Nov. 19, 2008 in Appln. No. 20158005093.2, 5 pages.
Chinese Office Action dated Mar. 15, 2013, re App No. 200910226583.9.
Chinese Office Action dated Mar. 16, 2018 in App. No. 2101580050958.4 w/translation.
Chinese Office Action dated Jul. 3, 2018, re App. No. 201580075755.0, 6 pages.
Chinese Office Action dated Jun. 12, 2018 in corresponding Chinese Patent Application No. 201580050912.2, translated, 7 pages.
Chinese Office Action dated Mar. 16, 2018, re App. No. 201580050911.8.
Chinese Office Action dated Oct. 29, 2013, re App No. 201080008236.X.
Chinese Office Action, dated Sep. 2, 2014, by SIPO, re App No. 201080008236.X.
Decision on Appeal mailed Feb. 20, 2013, by USPTO, re U.S. Appl. No. 10/831,467.
Dirk Guth et al., "New Technoloy for a High Dynamical MRF-Clutch for Safe and Energy-Efficient Use in Powertrain," FISITA 2012 World Automotive Congress, Beijing, China, Nov. 27-30, 2012, 31 pages.
Election Requirement, mailed Nov. 18, 2014, by the USPTO, re U.S. Appl. No. 29/455,618.
*Estee Lauder Inc*. v. *L'Oreal, USA*, 129 F.3d 588, 44 U.S.P.Q.2d 1610, No. 96-1512, United States Court of Appeals, Federal Circuit, Decided Nov. 3, 1997.
European Examination Report dated Mar. 5, 2019 in EP Application No. 15746766.3, 7 pages.
European Search Report in corresponding European Patent Application No. 15746766.3 dated May 30, 2017, 9 pages.
Examination Report in Australian Application No. 2015292354 dated Nov. 12, 2018; 3 pages.
Examiner's Answer dated Jan. 29, 2010, by USPTO, re U.S. Appl. No. 10/831,467.
Examiner's Interview Summary dated Apr. 10, 2008, by the USPTO, re U.S. Appl. No. 10/833,921.
Examiners Intervew Summary dated Jul. 17, 2008, by the USPTO, re U.S. Appl. No. 10/831,467.
Extended European Search Report dated Jul. 18, 2018, by EPO, re App. No. 15873853.4, 11 pages.
Extended European Supplementary Search Report in corresponding European Patent No. 15825024.1 dated Jan. 23, 2018, 8 pages.
Final Office Action on U.S. Appl. No. 14/616,472 dated Nov. 1, 2018.
Finaf Office Action on U.S. Appl. No. 14/808,513 dated Apr. 19, 2018.
Final Office Action on U.S. Appl. No. 14/808,618 dated Jan. 17, 2019.
Final Office Action on U.S. Appl. No. 14/808,618 dated Jul. 13, 2018.
Final Office Action on U.S. Appl. No. 14/808,618 dated May 4, 2018.
Final Office Action on U.S. Appl. No. 14/808,726 dated Dec. 11, 2018.
Gardner Denver Well Servicing Pump Model C-2500Q Power End Parts List, Feb. 2009.
International Preliminary Reporton Patentability dated Feb. 9, 2017 in PCT/US2015/042111, 9 pages.
International Preliminary Report on Patentability in corresponding international application No. PCT/US2015/42104; 8 pages.
International Preliminary Report on Patentability dated Jun. 27, 2017 in PCT/US2015/042119, 10 pages.
International Preliminary Report on Patentability dated Mar. 10, 2017 in corresponding application No. PCT/US2015/042078, 10 pages.
International Preliminary Report on Patentability dated Mar. 10, 2017 in International Application No. PCT/US2015/042078, 10 pages.
International Preliminary Report on Patentability dated Mar. 10, 2017 in PCT/US15/42078, 10 pages.
International Preliminary Report on Patentability, by the IPEA/US, dated Aug. 23, 2016 re PCT/US2013/042043.
International Preliminary Report on Patentability, by the IPEA/US, dated Feb. 9, 2017 in corresponding PCT Application No. PCT/US15/042111, 9 pages.
International Preliminary Report on Patentability, by the IPEA/US, dated Jan. 4, 2012 re PCT/US2010/039651.
International Preliminary Report on Patentability, by the IPEA/US, dated Jul. 12, 2011 re PCT/US2010/020445.
International Preliminary Report on Patentability, by the IPEA/US, dated Jul. 12, 2011 re PCT/US2010/020447.
International Preliminary Report on Patentability, by the IPEA/US, dated Mar. 9, 2015 re PCT/US2013/040106.
International Preliminary Reporton Patentability, by the IPEA/US, dated May 20, 2016 in PCT Application No. PCT/US15/014898, 10 pages.
International Preliminary Report on Patentability, by the IPEA/US, dated Sep. 16, 2016 re PCT/US2015/042104.
International Search Report and Written Opinion dated Dec. 28, 2015 in corresponding international application PCT/US2015/042043, 14 pages.
International Search Report and Written Opinion dated Dec. 28, 2015 in corresponding PCT application PCT/US2015/042043, 14 pages.
International Search Report and Written Opinion dated Dec. 4, 2015 in corresponding PCT Application PCT/US2015/042111; 13 pages.
International Search Report and Written Opinion dated Jun. 29, 2015 in corresponding PCT application PCT/US2015/014898, 14 pages.
International Search Report and Written Opinion dated Oct. 19, 2015 in corresponding PCT Application PCT/US2015/042104, 11 pages.
International Search Report and Written Opinion dated Oct. 19, 2015 in corresponding PCT application, PCT/US2015/042119; 12 pages.
International Search Report and Written Opinion dated Oct. 19, 2015 in corresponding PCT/US2015/042104; 11 pages.
International Search Report and Written Opinion, by the ISA/US, dated Aug. 28, 2012, re PCT/US2011/067770, 6 pages.
International Search Report and Written Opinion, by the ISA/US, dated Aug. 3, 2010, re PCT/US2010/020445, 7 pages.
International Search Report and Written Opinion, dated Aug. 3, 2010, re PCT/US2010/020447, 7 pages.
International Search Report and Written Opinion, by the ISA/US, dated Feb. 24, 2011, re PCT/US2010/039651, 7 pages.
International Search Report and Written Opinion, by the ISA/US, dated Mar. 4, 2015, re PCT/US2014/069567.
International Search Report and Written Opinion, by the ISA/US, dated Nov. 27, 2015, re PCT/US2015/038008.
International Search Report and Written Opinion, by the ISA/US, dated Oct. 19, 2015, re PCT/US2015/042104.
International Search Report and Written Opinion, by the ISA/US, dated Oct. 19, 2015, re PCT/US2015/042119.
International Search Report and Written Opinion, by the ISA/US, dated Sep. 5, 2013, re PCT/US2013/040106.
International Search Report dated Dec. 4, 2015 in corresponding PCT application PCT/US2015/042078, 13 pages.
International Search Report dated Dec. 4, 2015 in corresponding PCT application, PCT/US2015/042111, 13 pages.
International Search Report dated Jun. 29, 2015 in corresponding PCT application, PCT/US2015/014898, 14 pages.
International Search Report dated Oct. 19, 2015 in corresponding PCT/US2015/042104; 10 pages.

(56) References Cited

OTHER PUBLICATIONS

MSI/Dixie Iron Works, Ltd., Technical Manual for MSI Hybrid Well Service Pump Triplex and Quintuplex Modesl, Rev. D, 91 pages, date unknown.
Non-Final Office Action on U.S. Appl. No. 14/616,472 dated Mar. 13, 2019.
Non-Final Office Action on U.S. Appl. No. 14/808,513 dated Oct. 4, 2018.
Non-Final Office Action on U.S. Appl. No. 14/808,618 dated Aug. 15, 2018.
Notice of Allowance dated Dec. 23, 2011, by the USPTO, re U.S. Appl. No. 12/277,849.
Notice of Allowance dated Feb. 12, 2016, by the USPTO, re U.S. Appl. No. 29/534,091.
Notice of Allowance dated Jan. 28, 2015, by the USPTO, re U.S. Appl. No. 29/455,618.
Notice of Allowance dated May 25, 2018, by the USPTO, re U.S. Appl. No. 14/808,581, 10 pages.
Notice of Allowance dated Oct. 12, 2012, by the USPTO, re U.S. Appl. No. 12/683,804.
Notice of Allowance on U.S. Appl. No. 14/808,513 dated Feb. 15, 2019.
Notice bf Allowance on U.S. Appl. No. 14/808,581 dated Sep. 6, 2018.
Notice of Allowance on U.S. Appl. No. 14/808,726 dated Apr. 3, 2019.
Office Action in Canada Application No. 2,972,031 dated Nov. 27, 2018;5 pages.
Office Action dated Apr. 19, 2012, by the USPTO, re U.S. Appl. No. 12/821,663.
Office Action dated Apr. 19, 2018, by the USPTO, re U.S. Appl. No. 14/808,513.
Office Action dated Jan. 6, 2017, by the USPTO, re U.S. Appl. No. 15/808,581.
Office Action dated Jan. 18, 2013, by the USPTO, re U.S. Appl. No. 12/748,127.
Office Action dated Jan. 2, 2014, by the USPTO, re U.S. Appl. No. 13/866,121.
Office Action dated Jan. 21, 2009, by the USPTO, re U.S. Appl. No. 10/833,921.
Office Action dated Jan. 27, 2012, by the USPTO, re U.S. Appl. No. 12/683,804.
Office Action dated Jul. 16, 2007, by the USPTO, re U.S. Appl. No. 10/831,467.
Office Action dated Jul. 16, 2012, by the USPTO, re U.S. Appl. No. 12/683,804.
Office Action dated Jul. 28, 2008, by the USPTO, re U.S. Appl. No. 10/833,921.
Office action dated Jun. 1, 2016, by the USPTO, re U.S. Appl. No. 14/565,962.
Office Action dated Jun. 24, 2009, by the USPTO, re U.S. Appl. No. 10/831,467.
Office Action dated Jun. 30, 2017, by the USPTO, re U.S. Appl. No. 15/808,581, 17 pages.
Office Action dated Mar. 9, 2012, by the USPTO, re U.S. Appl. No. 12/821,663.
Office Action dated May 23, 2013, by the USPTO, re U.S. Appl. No. 12/683,900.
Office Action dated May 29, 2007, by the USPTO, re U.S. Appl. No. 10/833,921.
Office Action dated May 7, 2008, by the USPTO, re U.S. Appl. No. 10/831,467.
Office Action dated Nov. 22, 2017, by the USPTO, re U.S. Appl. No. 15/808,581, 15 pages.
Office Action dated Nov. 14, 2008, by the USPTO, re U.S. Appl. No. 10/831,467.
Office Action dated Oct. 11, 2011, by the USPTO, re U.S. Appl. No. 12/277,849.
Office Action dated Oct. 7, 2013, by the USPTO, re U.S. Appl. No. 13/843,525.
Office Action dated Sep. 21, 2017, by the USPTO, re U.S. Appl. No. 14/808,513.
Office Action dated Sep. 18, 2007, by the USPTO, re U.S. Appl. No. 10/833,921.
Office Action dated Sep. 29, 2014, by the USPTO, re U.S. Appl. No. 13/339,640.
Office Action/Restriction dated Mar. 29, 2016, by the USPTO, re U.S. Appl. No. 14/565,962.
Patent Examination Report issued in corresponding Australian Patent Application No. 2015213780, dated Sep. 22, 2016, 3 pages.
Second Office Action in Chinese Application 201580050911.8 dated Nov. 26, 2018, 5 pages.
Suction requirements Reciprocating Power Pumps, p. 59, Figure 3.4 Composite Pump Dynamics.
Supplemental Notice of Allowance dated Mar. 21, 2012, by the USPTO, re U.S. Appl. No. 12/277,849.
U.S. Notice of Allowance on U.S. Appl. No. 14/808,581 dated May 25, 2018.
U.S. Office Action on U.S. Appl. No. 14/808,726 dated Jun. 1, 2018.

* cited by examiner

RECIPROCATING PUMP WITH DUAL CIRCUIT POWER END LUBRICATION SYSTEM

PRIORITY CLAIM

This application is a continuation application of U.S. patent application Ser. No. 14/808,726, filed on Jul. 24, 2015, now pending, which claims priority to U.S. Provisional Application for Patent No. 62/099,377 filed on Jan. 2, 2015, entitled "Reciprocating Pump with Dual Circuit Power End Lubrication System," and U.S. Provisional Application for Patent No. 62/095,650 filed on Dec. 22, 2014, entitled "Reciprocating Pump with Dual Circuit Power End Lubrication System," the disclosures of each of which are incorporated herein by reference.

TECHNICAL FIELD

This disclosure relates in general to reciprocating pumps and, more particularly, to a dual circuit lubrication system to lubricate and cool rolling and sliding surfaces of a power end of a reciprocating pump assembly.

BACKGROUND OF THE DISCLOSURE

Large pumps are commonly used for mining and oilfield applications, such as, for example, hydraulic fracturing. During hydraulic fracturing, fracturing fluid (i.e., cement, mud, frac sand and other material) is pumped at high pressures into a wellbore to cause the producing formation to fracture. One commonly used pump in hydraulic fracturing is a high pressure reciprocating pump, like the SPM® QWS 3500 frac pump, manufactured by S.P.M. Flow Control, Inc. of Fort Worth, Tex. In operation, the fracturing fluid is caused to flow into and out of a pump housing having a fluid chamber as a consequence of the reciprocation of a piston-like plunger respectively moving away from and toward the fluid chamber. As the plunger moves away from the fluid chamber, the pressure inside the chamber decreases, creating a differential pressure across an inlet valve, drawing the fracturing fluid through the inlet valve into the chamber. When the plunger changes direction and begins to move towards the fluid chamber, the pressure inside the chamber substantially increases until the differential pressure across an outlet valve causes the outlet valve to open, enabling the highly pressurized fracturing fluid to discharge through the outlet valve into the wellbore.

A typical reciprocating pump includes multiple lubrication systems: a fluid end lubrication system that lubricates and cools the bearing surfaces of a fluid end, and a power end lubrication system that lubricates and cools the rolling and sliding of, for example bearing, surfaces of a power end. In the power end, it can be beneficial to supply some rolling and sliding surfaces with a higher pressure of lubrication fluid than other rolling and sliding surfaces. In present systems, however, the rolling and sliding surfaces of the power end are lubricated by the same lubrication circuit and thus, are generally lubricated at the same lubrication fluid pressure.

In operation, the pressure of the lubrication fluid received by a particular surface depends on the flow of lubrication fluid from the lube pump and the resistance to the flow created by the outlets in the lubrication circulating system. Because some components, such as roller bearings and gears, have lubrication fluid (i.e., oil) flowing out at approximately atmospheric pressure, the single circuit lubrication system oftentimes fails to provide sufficient lubrication fluid pressure and flow to ensure that all parts, especially sliding surfaces, which can require a higher lubrication fluid pressure, are properly lubricated. In order to ensure adequate lubrication of the power end, the required lubrication pressure and flow rate to all of the rolling and sliding surfaces is increased; however, such increases create inefficiencies in the power end lubrication system and thus, inefficiencies in the operation of the reciprocating pump.

SUMMARY

In a first aspect, there is provided a dual circuit lubrication system for a power end of a reciprocating pump that includes a lubrication pump that supplies lubrication fluid to a high pressure lubrication circuit and a low pressure lubrication circuit. The high pressure lubrication circuit is fluidly coupled to a crankshaft to supply lubrication fluid to sliding surfaces associated with the crankshaft at a first lubrication fluid pressure. The crankshaft drives a crosshead coupled to a plunger to displace fluid from a fluid end of the reciprocating pump. The low pressure lubrication circuit is fluidly coupled to supply the lubrication fluid to a plurality of rolling surfaces associated with the crankshaft at a second lubrication fluid pressure. The first lubrication fluid pressure is greater than the second lubrication fluid pressure.

In certain embodiment, the first lubrication fluid pressure is at least 1.5 times the second lubrication fluid pressure.

In certain embodiments, the high pressure lubrication circuit supplies the lubrication fluid to a bottom portion of the crosshead.

In other certain embodiments, the low pressure lubrication circuit supplies the lubrication fluid to a top portion of the crosshead.

In yet another embodiment, the low pressure lubrication outlet supplies the lubrication fluid to a gearbox associated with the reciprocating pump.

In still yet another embodiment, the lubrication pump includes a high pressure lubrication pump that is fluidly coupled to the high pressure lubrication circuit and a separate low pressure lubrication pump that is fluidly coupled to the low pressure lubrication circuit.

In other certain embodiments, the crankshaft drives at least three crossheads where each crosshead is coupled to a respective plunger.

In still another embodiment, the crankshaft drives five crossheads where each cross head is coupled to a respective plunger.

In yet another embodiment, the lubrication pump is a positive displacement-type pump.

In still yet another embodiment, the crosshead moves within a crosshead housing and a bushing is disposed between the crosshead and the crosshead housing.

In yet another embodiment, the lubrication pump is secured to a gearbox associated with the reciprocating pump.

In a second aspect, there is provided a reciprocating pump with a dual circuit lubrication system. The reciprocating pump includes a fluid end that is coupled to a power end and supplies fluid at a high pressure into a wellbore. A high pressure lubrication circuit supplies lubrication fluid to the power end, and a low pressure lubrication circuit supplies lubrication fluid to the power end. A first lubrication pressure of the high pressure lubrication circuit is higher than a second lubrication fluid pressure of the low pressure lubrication circuit.

In an embodiment, the first lubrication fluid pressure is at least one-and-a-half (1.5) the second lubrication fluid pressure.

In yet another embodiment, the low pressure lubrication circuit supplies the lubrication fluid to a top portion of a crosshead, and the high pressure lubrication circuit supplies the lubrication fluid to a bottom portion of the crosshead.

In still another embodiment, the low pressure lubrication circuit supplies the lubrication fluid to a plurality of rolling surfaces associated with rotation of a crankshaft of the power end.

In other certain embodiments, the low pressure lubrication circuit supplies the lubrication fluid to a gearbox.

In yet another embodiment, the high pressure lubrication circuit supplies the lubrication fluid to a pin of a crankshaft.

In still yet another embodiment, the reciprocating pump includes at least one pressure control valve that is configured to maintain the second lubrication fluid pressure in the low pressure lubrication circuit.

In certain embodiments, at least one check valve is disposed within either the high pressure lubrication circuit or the low pressure lubrication circuit. The check valve allows recirculation of the lubrication fluid in the low pressure lubrication circuit while the reciprocating pump is in neutral and recirculation of the lubrication fluid in both the high and the low pressure lubrication fluid circuits simultaneously when the reciprocating pump is pumping.

In a third aspect, there is provided a method for lubricating a power end of a reciprocating pump that includes simultaneously supplying lubrication fluid through a low pressure lubrication circuit and a high pressure lubrication circuit. A first lubrication pressure at of the high pressure lubrication circuit is greater than a second lubrication fluid pressure of the low pressure lubrication circuit.

In one embodiment, the first lubrication fluid pressure is at least 1.5 times the second lubrication fluid pressure.

In certain embodiments, the low pressure lubrication circuit supplies the lubrication fluid to a top portion of a crosshead and the high pressure lubrication circuit supplies the lubrication fluid to a bottom portion of the crosshead.

In other embodiments, the low pressure lubrication circuit supplies the lubrication fluid to a plurality of rolling surfaces associated with rotation of a crankshaft of the power end.

In still other embodiments, the low pressure lubrication circuit supplies the lubrication fluid to a gearbox associated with the power end.

In yet another embodiment, the high pressure lubrication circuit supplies the lubrication fluid to a pin of a crankshaft.

Other aspects, features, and advantages will become apparent from the following detailed description when taken in conjunction with the accompanying drawings, which are a part of this disclosure and which illustrate, by way of example, principles of the inventions hereof.

BRIEF DESCRIPTION OF THE FIGURES

Embodiments are illustrated by way of example in the accompanying figures, in which like reference numbers indicate similar parts, and in which.

DETAILED DESCRIPTION

Figure 1A:
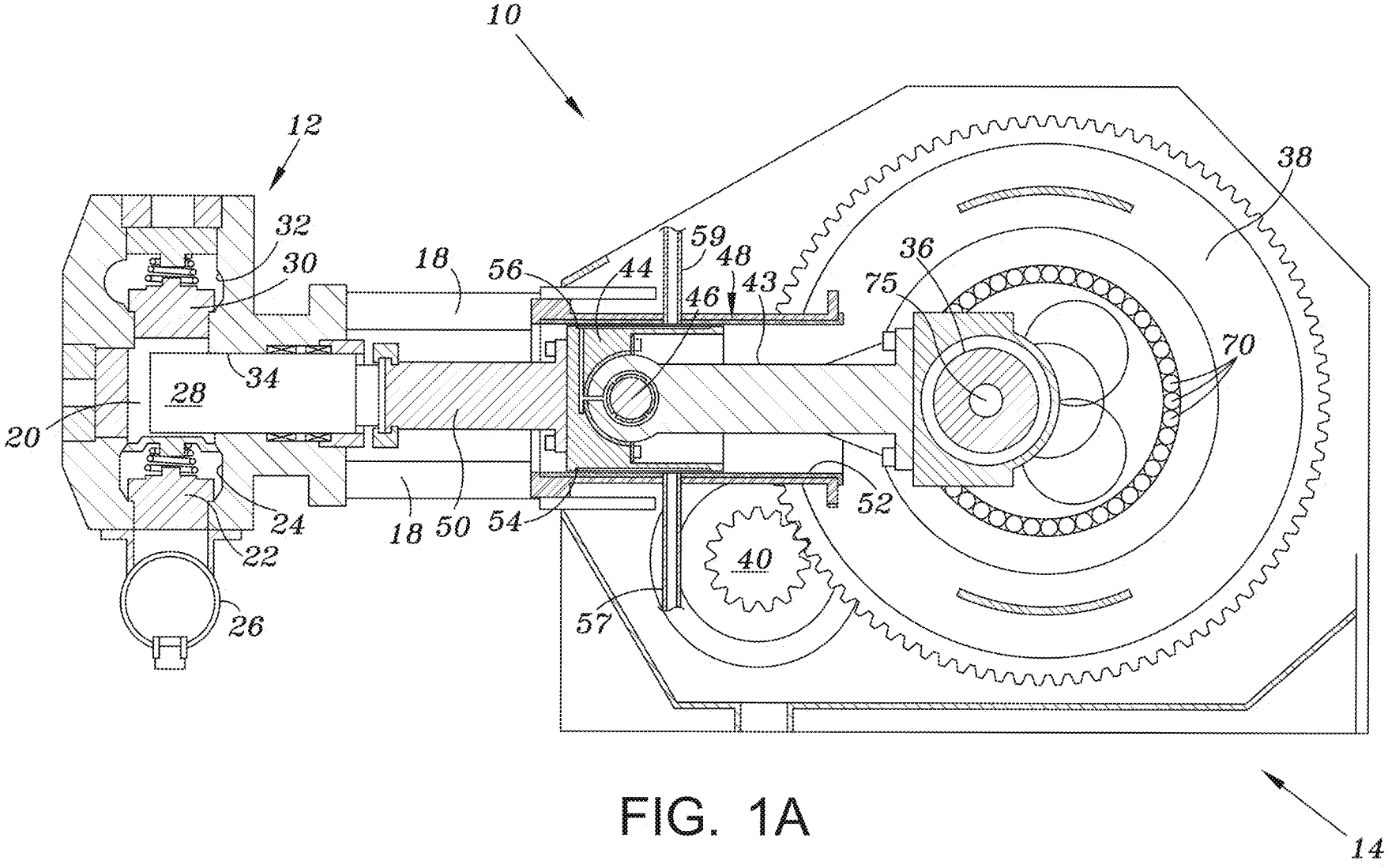
FIG. 1A is a section view of a portion of a reciprocating pump assembly illustrating a power end section coupled to a fluid end section and depicts a portion of a dual circuit power end lubrication system.

FIGS. 1A-3D illustrate embodiments of a reciprocating pump assembly 10 in which a dual circuit power end lubrication system 16 (FIGS. 2A-3D) is employed to lubricate rolling and sliding surfaces in a power end section 14 of the reciprocating pump assembly 10. Referring specifically to FIG. 1A, the reciprocating pump assembly 10 includes a fluid end 12 coupled to the power end 14. As discussed in greater detail below, the dual circuit power end lubrication system 16 (FIGS. 2A-3D) recirculates a lubrication fluid to lubricate and cool certain components of the power end section 14, including, but not limited to, rolling and sliding surfaces and bearing components. The rolling and sliding surfaces include, for example, sliding bearing surfaces, roller bearing surfaces, and meshed gear tooth surfaces.

In order to ensure proper lubrication of rolling and sliding surfaces that require higher lubrication fluid pressure, conventional single circuit lubrication systems supply lubrication fluid at an elevated lubrication fluid pressure (also referred to herein as lubrication pressure) whether the particular surface requires elevated lubrication fluid pressure or not. The dual circuit lubrication system 16 uses energy, which can be supplied by a diesel engine, efficiently because less energy (e.g., diesel engine power) is used to supply certain sliding surfaces with high pressure lubrication fluid, and energy (e.g., diesel engine power) is not wasted in supplying elevated lubrication pressure to rolling surfaces that do not require high pressure lubrication fluid.

In operation and as discussed below, a particular surface receives lubrication fluid at a higher pressure or a lower pressure depending on whether it is fluidly coupled to a high pressure lubrication circuit 100 or a low pressure lubrication circuit 102 (FIGS. 3A-3D). According to one embodiment, the lubrication fluid pressure in the low pressure lubrication circuit 102 and at each outlet of the low pressure lubrication circuit 102 where the lubrication fluid is delivered to rolling and sliding surfaces of the power end 14 is in the range of 35-65 pounds per square inch (PSI) at approximately 37 gallons per minute (Gpm) flow rate. In one embodiment, the lubrication fluid pressure range for the low pressure lubrication circuit 102 is 45-50 PSI. In some embodiments, the lubrication fluid pressure range for the low pressure lubrication circuit 102 are equal to or less than 35 PSI (e.g., 30 PSI, 25 PSI, 20 PSI, or less), and, in other embodiments, the lubrication fluid pressure range for the low pressure lubrication circuit is equal to or greater than 65 PSI (e.g., 70 PSI, 75 PSI, or more). The specific rolling and sliding surfaces that are lubricated by the low pressure lubrication circuit 102 are described in more detail below.

In some embodiments, the lubrication fluid pressure in the high pressure lubrication circuit 100 and at each outlet of the high pressure lubrication circuit 100 where the lubrication fluid is delivered to certain sliding surfaces is about 1.5 times the lubrication fluid pressure of the low pressure lubrication circuit 102. According to one embodiment, the rolling surfaces of the power end are not lubricated by high pressure lubrication circuit 100. The high pressure lubrication circuit 100 is not limited to a lubrication fluid pressure of 1.5 times the lubrication fluid pressure of the low pressure lubrication circuit 102, but may be two times, three times, or four times the lubrication fluid pressure of the low pressure lubrication circuit 102, or more. In some embodiments, the pressure of the high pressure lubrication circuit 100 may be less than 1.5 times the lubrication fluid pressure of the low pressure lubrication circuit 102 provided the difference in the lubrication fluid pressures of the high and low circuits is substantial (e.g., 1.4, 1.3, 1.2 times the lubrication fluid pressure of the low pressure lubrication circuit 102, or less).

In some embodiments, the lubrication fluid pressure of the high pressure lubrication circuit about 100 is 80-120 PSI at approximately 30 gallons per minute (Gpm) flow rate. According to one embodiment, the lubrication fluid pressure in the high pressure lubrication circuit 100 is about 90-100 PSI. The specific sliding surfaces receiving lubrication fluid from the high pressure lubrication circuit 100 are discussed in more detail below.

The actual lubrication fluid pressure will vary slightly across the various outlets of the particular lubrication fluid circuit depending on the operating temperature and the resulting viscosity of the lubrication fluid.

Referring specifically to FIG. 1A, the fluid end 12 of the reciprocating pump 10 is structurally connected to the power end 14 by a plurality stay rods 18. The fluid end 12 includes one or more fluid chambers 20 (only one shown). In certain embodiments, a quintuplex reciprocating pump includes five fluid chambers 20. However, other reciprocating pump configurations include one, two, three, four or any number of fluid chambers 20 and associated components to pump fluid into a wellbore. In the embodiment illustrated in FIG. 1A, the pump assembly 10 is to be mounted on a skid supported by the ground or mounted to a trailer that can be towed between operational sites, and/or mounted, for example, to a skid for use in offshore operations.

With continued reference to FIG. 1A, a suction valve 22 is disposed within a suction bore 24. Fluid is drawn from a suction manifold 26 through the suction valve 22 and into the fluid chamber 20. The fluid is then pumped in response to a forward stroke of a plunger 28 and flows through a discharge valve 30 into a discharge bore 32 that is fluidly coupled to a wellbore to supply high pressure fluid to the wellbore for fracturing rock formations and other uses.

In operation, the reciprocating plunger 28 moves in a plunger bore 34 and is driven by the power end 14 of the reciprocating pump 10. The power end 14 includes a crankshaft 36 that is rotated by a gearbox output 38, illustrated by a single gear but may be more than one gear as described further below. A gearbox input 40 is coupled to a transmission and rotates a gear reduction system that drives the gearbox output 38 at a desired rotational speed to achieve the desired pumping power. A power source, such as a diesel engine (not shown), connects to an input flange 42 (see FIGS. 2A and 2C) and rotates the gearbox input 40 during operation. A connecting rod 43 mechanically connects the crankshaft 36 to a crosshead 44 via a wrist pin 46. The crosshead 44 is mounted within a stationary crosshead housing 48, which constrains the crosshead 44 to linear reciprocating movement. A pony rod 50 connects to the crosshead 44 and has its opposite end connected to the plunger 28 to enable reciprocating movement of the plunger 28. In some embodiments, the plunger 28 is optionally directly coupleable to the crosshead 44 to eliminate the pony rod 50. In the embodiment illustrated in FIG. 1A, the plunger 28 may be one of a plurality of plungers, such as, for example, three or five plungers, depending on the size of the pump assembly 10 (i.e., three cylinder, five cylinder, etc.) and the number of fluid chambers 20.

As illustrated in FIG. 1A, the plunger 28 extends through the plunger bore 34 so as to interface and otherwise extend within the fluid chamber 20. In operation, movement of the crankshaft 36 causes the plunger 28 to reciprocate or move linearly toward and away from, the fluid chamber 20. As the plunger 28 translates away from the chamber 20, the pressure of the fluid inside the fluid chamber 20 decreases, which creates a differential pressure across the suction valve 22. The pressure differential within the chamber 20 enables actuation of the valve 22 to allow the fluid to enter the chamber 20 from the suction manifold 26. The pumped fluid is drawn within the fluid chamber 20 as the plunger 28 continues to translate away from the fluid chamber 20. As the plunger 28 changes directions and moves toward the fluid chamber 20, the fluid pressure inside the chamber 20 increases. Fluid pressure inside the chamber 20 continues to increase as the plunger 28 approaches the chamber 20 until the differential pressure across the discharge valve 30 is great enough to actuate the valve 30 and enable the fluid to exit the chamber 20.

The dual circuit lubrication system 16 (schematically illustrated in FIGS. 3A-3D) provides lubrication fluid to lubricate the sliding surfaces associated with the crankshaft 36 and the crosshead 44. A crankshaft pin conduit 75 is coupled to the high pressure lubrication circuit 100 and runs through the crankshaft 36 to provide high pressure lubrication fluid to the sliding surfaces associated with the crankshaft 36.

The crankshaft 36 drives the crosshead 44 linearly within the crosshead housing 48. A sliding surface, a bushing 52 in the illustrated embodiment, is disposed between the crosshead 44 and an inner surface of the crosshead housing 48. As discussed in greater detail below, this interface receives both high and low pressure lubrication fluid from the dual circuit lubrication system 16. According to certain embodiments, the bushing 52 may be disposed between the crosshead 44 and the crosshead housing 48 and form the stationary surface on which the crosshead 44 slides within the crosshead housing 48. The bushing 52 may be replaceable and formed of, or coated with, bronze or like material, which reduces friction that would otherwise exist between the crosshead 44 and the crosshead housing 48.

Assuming counter-clockwise rotation of the crankshaft 36 from the perspective of FIG. 1A, forces on a bottom portion 54 of the crosshead 44 are opposed by the crosshead housing 48. Such forces result from the applied load through the mechanism components and the weight of the crosshead 44. The lubrication system 16, and more specifically the high pressure lubrication circuit 100, supplies lubrication fluid to the sliding surfaces on the bottom portion 54 of the crosshead 44 via a conduit 57 at a sufficiently high enough lubrication pressure to form a lubrication film that resists and/or otherwise overcomes the forces urging the bottom of the crosshead 44 toward and against the crosshead housing 48 (or the bushing 52, as applicable), thus reducing the friction on this sliding surface, which reduces wear and increases the operating life of the bushing 52. In one embodiment, the lubrication fluid pressure is in the range of 80-120 pounds per square inch (PSI). Preferably, the lubrication fluid lubricates the entire bottom sliding surface between the crosshead 44 and the crosshead housing 48 (or the bushing 52, as applicable).

Such increased lubrication fluid pressure is not needed for lubrication fluid communicated to the top portion 56 of the crosshead 44 and the bushing 52 disposed within the crosshead housing 48, since there is clearance between the crosshead 44 and the crosshead housing 48. In one embodiment, the lubrication fluid pressure is approximately 45-50 PSI. The lubrication fluid from inlet conduit 59 flows over and cools the crosshead 44, and provides lubrication to the components interfacing with and driving the crosshead 44. As such, the low pressure lubrication circuit 102 supplies the top portion 56 of the crosshead 44 through inlet conduit 59.

According to an alternate embodiment, the dual circuit lubrication system 16 accommodates clockwise rotation of the crankshaft 36 from the perspective of FIG. 1A. According to this embodiment, the higher lubrication fluid pressure is supplied to the top portion 56 of the crosshead 44 through the top crosshead conduit 59 of the high pressure lubrication circuit 100, and the lower lubrication fluid pressure from the low pressure lubrication circuit 102 is provided to the bottom portion 54 of the crosshead 44.

Figure 1B:
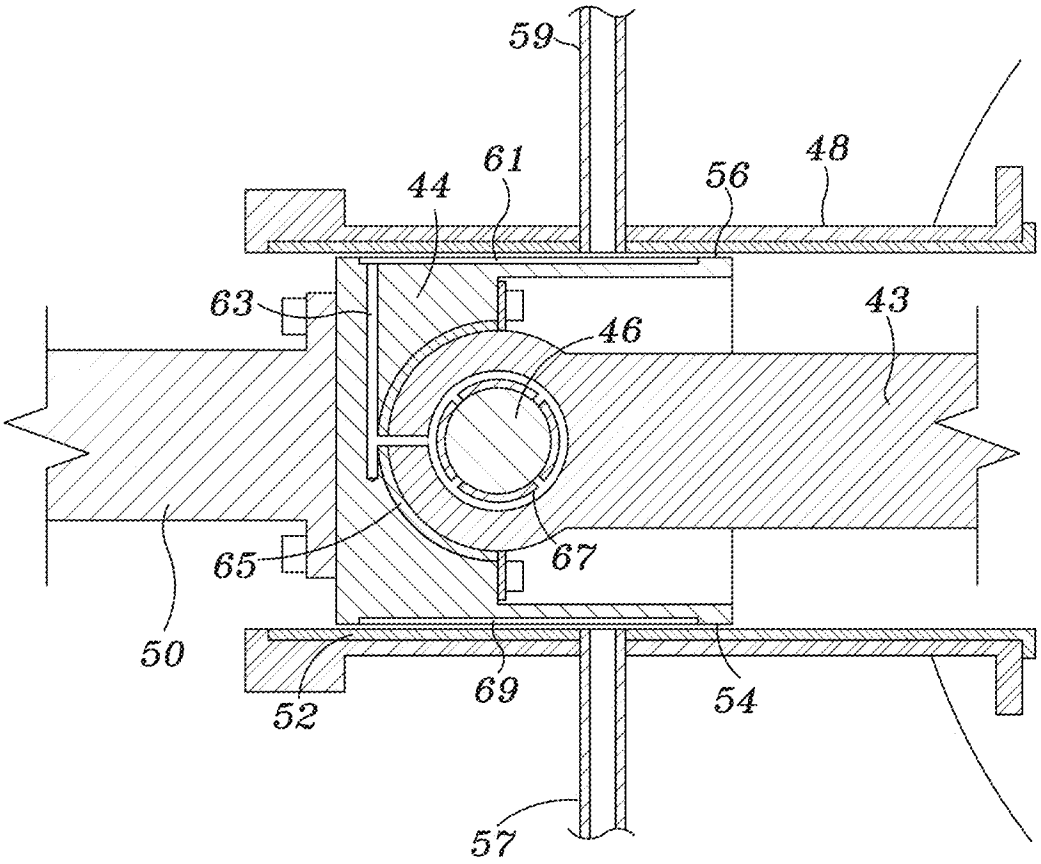
FIG. 1B is a detailed view of a portion of the sliding surfaces associated with the connection of the connecting rod to the crosshead illustrated in FIG. 1A and depicts a portion of a dual circuit power end lubrication system.

FIG. 1B is a detailed view of the crosshead 44 and the lubrication system providing lubrication to the top portion 56 and the bottom portion 54 of the crosshead 44. Lubrication fluid circulating through the low pressure lubrication circuit 102 (FIGS. 3A-3D) flows through conduit 59 and is received by upper lube channel 61 formed in the crosshead 44. This lubrication fluid flows through a knuckle bearing bore 63 to lubricate and cool a knuckle bearing 65 and a wrist pin bearing 67, which facilitate coupling and motion between the connecting rod 43 and the crosshead 44. The wrist pin 46 holds the connecting rod 43 and allows it to pivot in a recess in the crosshead 44.

Lubrication fluid circulating through the high pressure lubrication circuit 100 (FIGS. 3A-3D) is delivered through the conduit 57 and is received by a lower lube channel 69 that is formed in the crosshead 44. This lubrication fluid lubricates and cools the sliding surfaces associated with the bottom portion 54 of the crosshead 44.

According to one embodiment, the knuckle bearing 65 and the wrist pin 46 and their associated sliding surfaces receive sufficient lubrication fluid from the knuckle bearing bore 63, which is part of the low pressure lubrication circuit 102 such that the connecting rod 43 does not have a lubrication conduit running through it. Conventional power end lubrication systems have a lubrication conduit running through the connecting rod that supplies lubrication fluid to the knuckle bearing and the wrist pin from a conduit associated with the crankshaft. By introducing lubrication fluid at the low lubrication fluid pressure through knuckle bearing bore 63 more lubrication fluid is allowed to freely flow to lubricate and cool the sliding surfaces associated with the knuckle bearing 65 and the wrist pin 46. The crank pin and the crank pin bushing receive dedicated lubrication fluid from the high pressure lubrication circuit 100 that doesn't flow through the connecting rod 43 to the wrist pin 46. In addition, a groove and an orifice that fluidly couples the connecting rod in a conventional lubrication system can be eliminated, which leads to increased operating life of the crank pin and crank pin bushing.

Figures 2A, 2B:
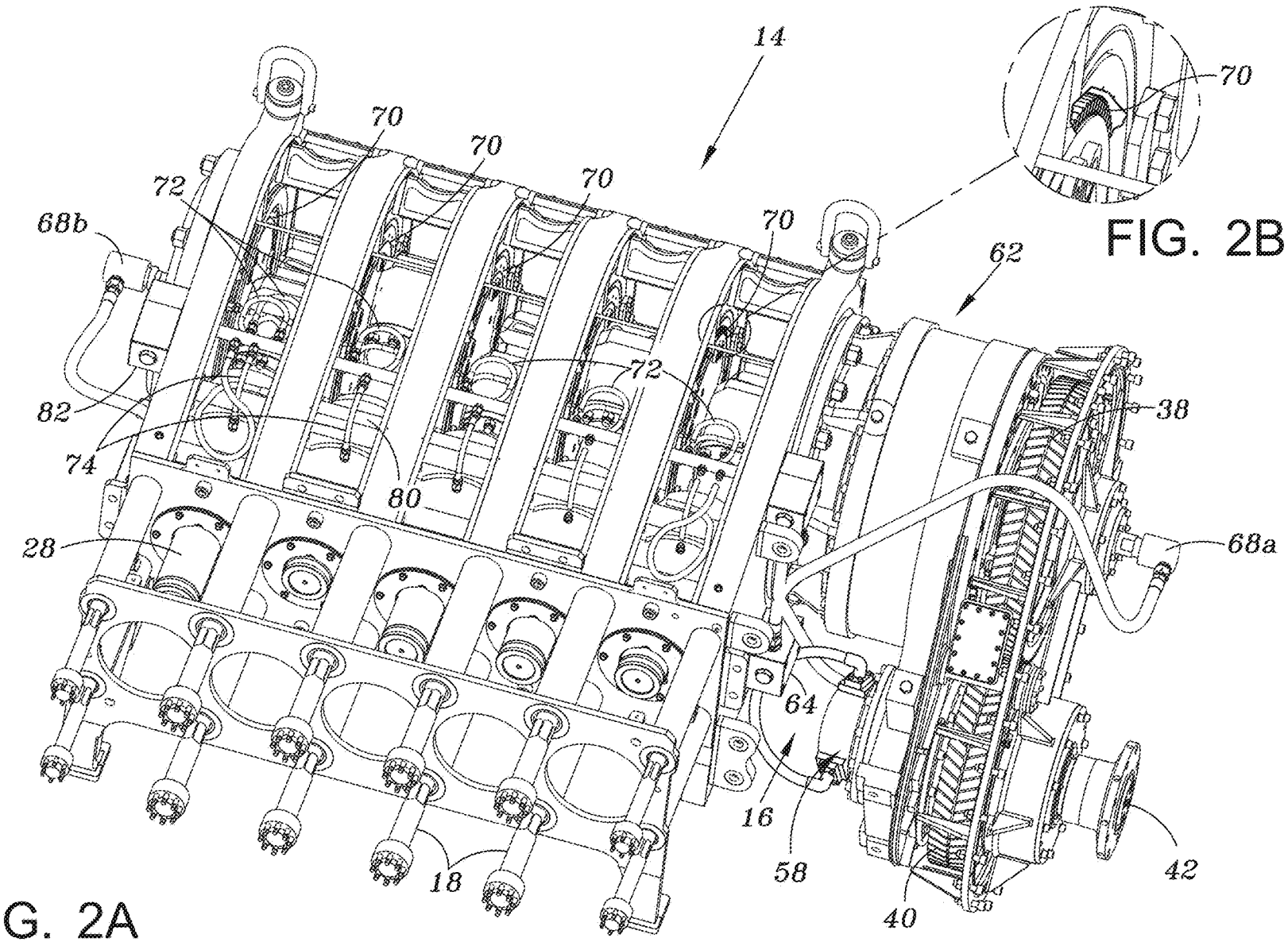
FIG. 2A is a top perspective view of portions of the power end of the reciprocating pump assembly of FIG. 1A incorporating a dual circuit power end lubrication system.
FIG. 2B is a detail view of rolling surfaces, such as surfaces associated with roller bearings of the power end of FIG. 2A.
Figure 2C:
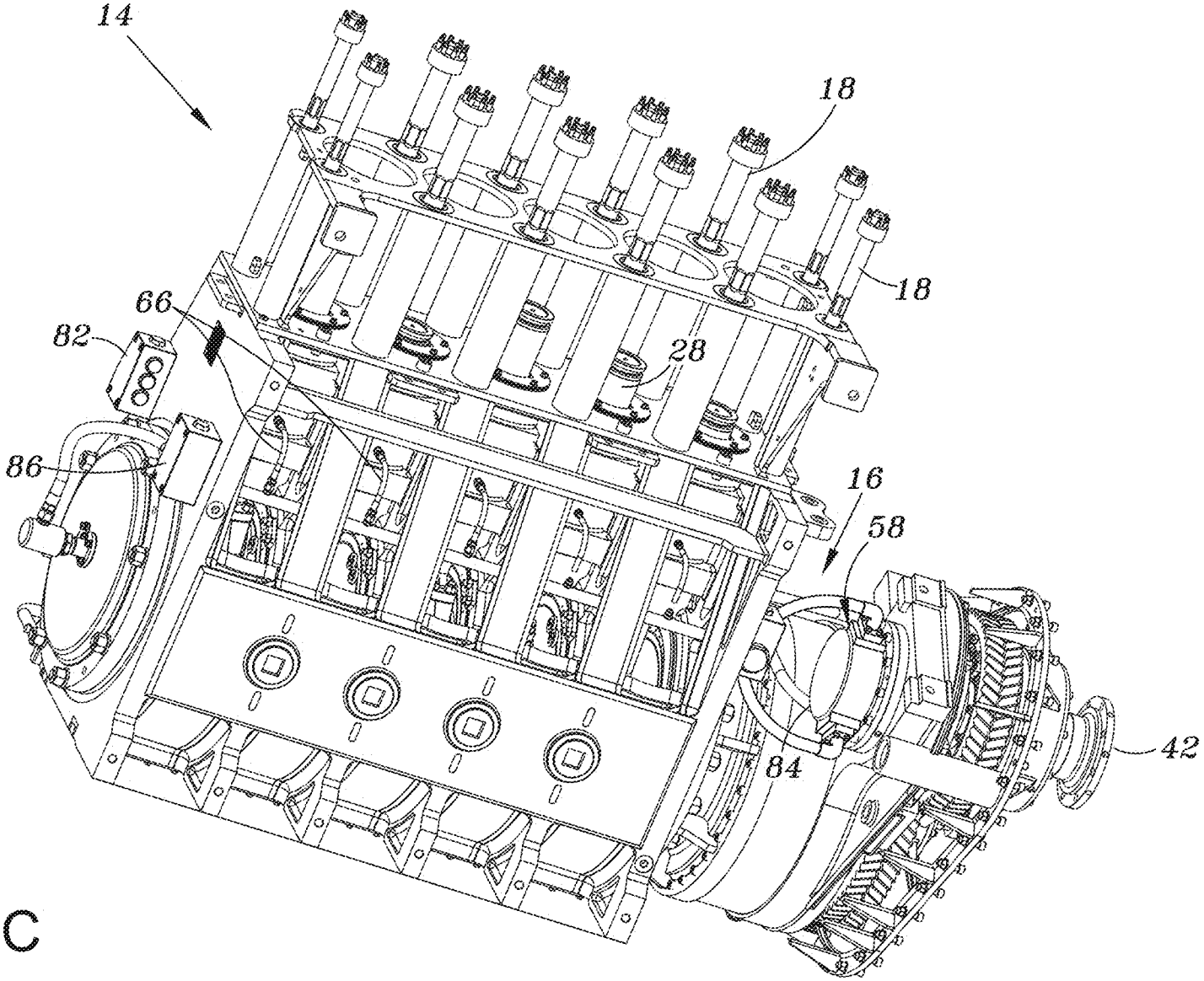
FIG. 2C is a bottom perspective view of portions of the power end of the reciprocating pump assembly of FIG. 1A incorporating a dual circuit power end lubrication system.

Referring now to FIGS. 2A-2C, which illustrate the power end 14 where certain portions have been omitted to allow for visibility of the sliding and rolling surfaces and lubrication fluid conduits. In the embodiment illustrated in FIGS. 2A-2C, the lubrication system 16 includes lubrication conduits that direct the lubrication fluid to the sliding and rolling surfaces of the power end 14. In one embodiment, at least one lubrication pump 58 is driven by the diesel engine, which also drives a shaft associated with the input flange 42. The lubrication pump may be any suitable type of pump that is operable to provide lubrication fluid output at the desired lubrication fluid pressure of either the high or low pressure lubrication circuits or both as described further with reference to FIGS. 3A-3D. The lubrication fluid can be any suitable lubricant, such as oil based lubricants. According to one embodiment, the lubrication pump is a dual stage gear-type pump. In an alternate embodiment, the lubrication pump is two separate pumps with two separate inlets and two separate outlets (e.g., each pump is configured to independently create lubrication fluid flow at the lubrication fluid pressure of one of the low pressure lubrication circuit and high pressure lubrication circuit). In still other embodiments, the lubrication pump is a single dual stage or two separate positive displacement pumps.

The dual circuit lubrication system 16 circulates lubrication fluid or lube oil to the lubrication conduits of the high pressure lubrication circuit 100 at a higher pressure (e.g., 90-135 PSI), and the same lubrication fluid circulates through the lubrication conduits of the low pressure lubrication circuit 102 at a relatively lower pressure (e.g., 45-50 PSI). The lubrication conduits may be made of any suitable material, such as rigid pipe or flexible hoses and may include one or more manifolds through which the lubrication fluid flows.

From the lubrication pump 58, the lubrication fluid flows to an input manifold 64. The input manifold 64 includes a plurality of outlets. One of the outlets fluidly couples the input manifold 64 to a plurality of crosshead bottom conduits 66 (FIG. 2C). Each of five crossheads 44 driving a reciprocating plunger receives lubrication fluid from respective crosshead bottom conduit 66. The lubrication fluid received by the crosshead bottom conduits 66 is received at a high pressure to allow the lubrication fluid to lubricate the sliding surfaces at the interface between the bottom outer surface of the crosshead 44 and the inner surface of a bushing 52 disposed within the crosshead housing 48.

According to one embodiment, an onboard lubrication fluid filter may be coupled to the power end 14 proximate the input manifold 64. The onboard lubrication fluid filter filters any suitable particulate size from being delivered to the rolling and sliding surfaces of the dual circuit lubrication system 16. For example, an onboard lubrication fluid filter may be a ten micron filter to ensure the dual circuit lubrication system 16 is providing lubrication fluid with only very small particulate to the rolling and sliding surfaces. Purifying the lubrication fluid using an onboard lubrication filter may lead to a longer operating life of components of the reciprocating pump 10.

The lubrication fluid also flows from the lubrication pump through the high pressure lubrication circuit to crankshaft inlets 68*a*, 68*b* disposed on each side of the crankshaft 36. The lubrication fluid supplied to the crankshaft inlets 68*a*, 68*b* is delivered at a high pressure such that the lubrication fluid can lubricate the sliding surfaces associated with the crankshaft 36, for example journal bearing surfaces (FIGS. 1A, 3A-3D). Each side of the crankshaft 36 includes an inlet 68*a* and 68*b*, such that each sliding surface associated with the crankshaft 36 receives high pressure lubrication fluid, as opposed to a single crankshaft inlet that would result in dissipating fluid pressure of the lubrication fluid as the lubrication fluid flows down the crankshaft 36 away from the lubrication pump 58.

Lubrication fluid also flows through the lubrication conduit of the low pressure lubrication circuit 102 at a lower pressure to deliver the lubrication fluid to a plurality of rolling surfaces, for example roller bearings 70, associated with the crankshaft 36. The roller bearings 70 are cylindrical rollers that facilitate rotational motion of the crankshaft 36. FIG. 1A also schematically illustrates roller bearings 70 associated with the crankshaft 36. Six roller bearing conduits 72 deliver the lubrication fluid to roller bearings 70 associated with each of five plungers 28.

The lubrication fluid is also supplied through the low pressure lubrication circuit 102 at a lower pressure to a plurality of crosshead top conduits 74. Each crosshead top conduit 74 is fluidly coupled to deliver lubrication fluid at a low pressure to the top portion 56 of the crosshead 44 through conduit 59 to lubricate and cool the crosshead 44, the knuckle bearing 65, and the wrist pin bearing 67 (FIG. 1B). A gearbox inlet 84 of the low pressure lubrication circuit also supplies the gearbox 62 to lubricate the various gear mesh interfaces (FIGS. 3A-3D).

According to the teachings of the present disclosure, the roller bearings 70, the meshing gear interfaces, and the top portion 56 of the crosshead 44 receive low pressure lubrication fluid, and the sliding surfaces associated with the crankshaft 36 and the bottom portion 54 of the crosshead 44 receive high pressure lubrication fluid. The sliding and/or rolling surfaces associated with the knuckle bearing 65 and the wrist pin bearing 67 receive low pressure lubrication fluid.

Figure 3A:
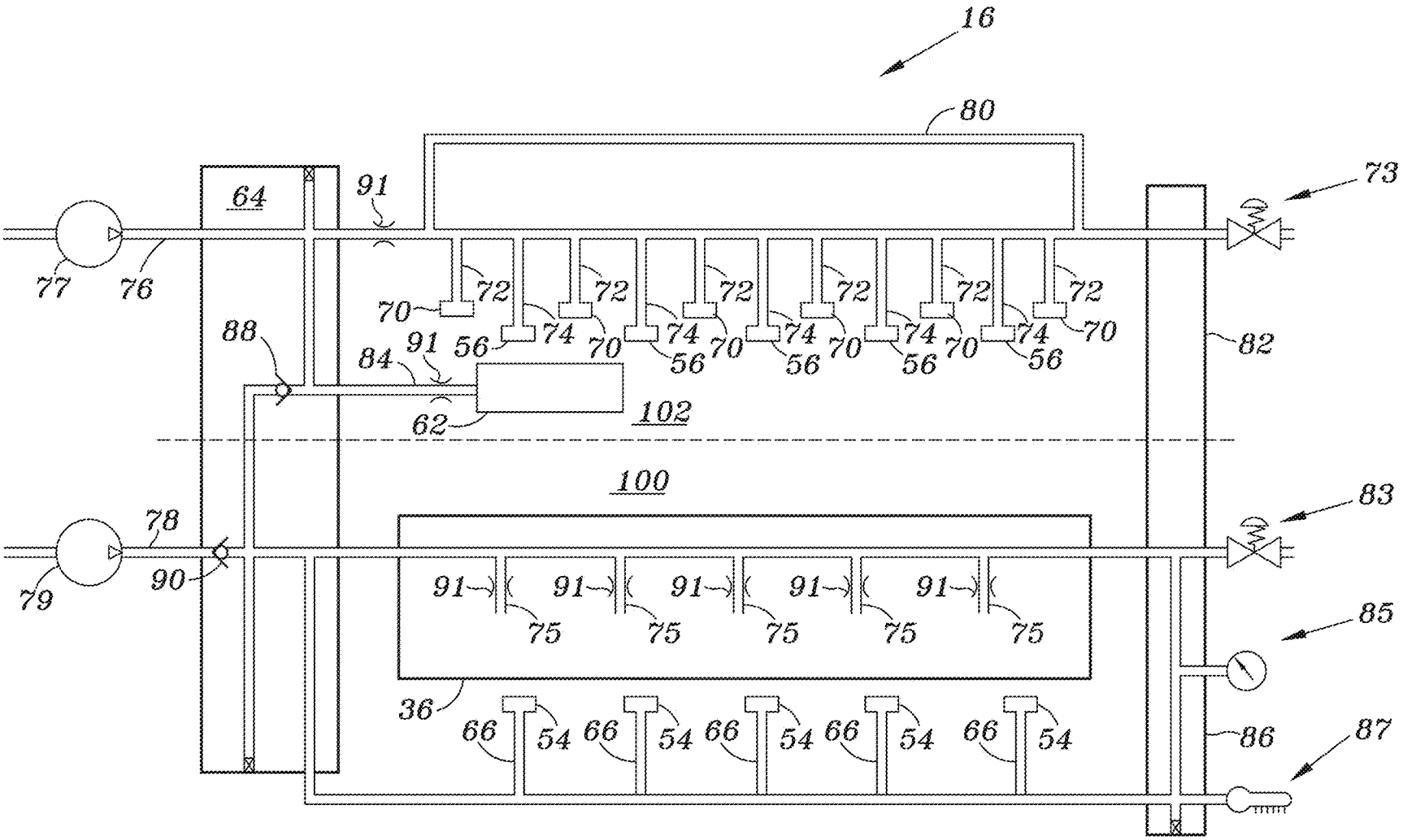
FIGS. 3A-3D are schematic illustrations of embodiments of the dual circuit power end lubrication system according to the teachings of the present disclosure.

Reference is now made to FIGS. 3A-3D, which are schematic illustrations of multiple embodiments of the dual circuit lubrication system 16 according to the teachings of the present disclosure. FIG. 3A illustrates the dual circuit lubrication system 16 employing two separate lubrication pumps. However, as previously described, the dual circuit lubrication system 16 can include a lubrication pump system with one lubrication pump producing lubrication fluid flow at two different outputs, one output supplying the low pressure lubrication circuit 102 at the low lubrication fluid pressure, and one output supplying the high pressure lubrication circuit 100 at the high lubrication fluid pressure. Or, as will be discussed below, the dual circuit lubrication system 16 may include a lubrication pump system with one lubrication pump and a pressure compensating valve. A low pressure lubrication pump 77 is driven by the drive shaft from the engine, and a high pressure lubrication pump 79 is driven by a drive shaft from the gearbox 62, for example the shaft of the gearbox input 40 (FIG. 1A).

In operation, low pressure lubrication fluid is supplied by the low pressure lubrication pump 77 to a low pressure lubrication conduit 76 in the range of 18-41 gallons per minute, for example, approximately 36.5 gallons per minute. The low pressure pump maintains the lower lubrication pressure of the low pressure lubrication circuit 102. The low pressure lubrication fluid flow splits such that a portion of the low pressure lubrication fluid is delivered to the gearbox 62 and a portion of the low pressure lubrication fluid is delivered to the roller bearing conduits 72 and the crosshead top conduits 74. The lubrication fluid received by the gearbox 62, the roller bearings 70, and the top portion 56 of the crosshead may pass through one or more orifice restrictors 91 to optimize the flow rate of the lubrication fluid to the gearbox 62, the roller bearings 70, and the top portion 56 of the crosshead and balance the temperatures of the lubrication fluid.

The lubrication fluid flows through the roller bearing conduits 72 and is received by the rolling surfaces of the roller bearings 70. The lubrication fluid flows through the crosshead top conduits 74 and is received by the sliding surfaces of the top portion 56 of the crosshead 44.

A bypass conduit 80 ensures that each of the crosshead top conduits 74 and each roller bearing conduit 72 receives lubrication fluid at approximately equal pressure. A second manifold 82 includes a pressure relief valve 73 for the low pressure lubrication circuit 102. Pressure relief valves are employed to allow cold lubrication fluid to be pumped at high pressures that actuate the relief valve until the lubrication fluid heats up and flows through the lubrication circuit at a pressure lower than the actuation pressure of the pressure relief valve. In certain embodiments, the actuation pressure of the pressure relief 73 valve may be approximately ten atmospheres (150 psi).

The lubrication fluid is also pumped by the low pressure lubrication pump 77 and received by the gearbox inlet 84 at a lower lubrication fluid pressure. The gearbox 62 includes any suitable number of gear interfaces where gears mesh to reduce rotational speed and increase torque. In some embodiments, the gearbox 62 includes gears in a planetary configuration. According to one embodiment, the gearbox 62 receives the lubrication fluid at a rate in the range of 10-22 gallons per minute, for example, approximately 20 gallons per minute. An example of meshing gears, which receive lubrication from the lubrication pump, is shown in FIG. 1A where the gearbox input 40 meshes with the gearbox output 38.

According to an embodiment of the present disclosure, each of the roller bearing conduits 72 receive lubrication fluid at a rate in the range of 1-3 gallons per minute, for example, approximately 1.5 gallons per minute, and each of the crosshead top lubrication conduits 74 receive lubrication fluid at a rate in the range of 1-3 gallons per minute, for example approximately 1.5 gallons per minute.

Lubrication fluid is provided by a high pressure lubrication pump 79 to the high pressure lubrication circuit 100 through the high pressure lubrication inlet conduit 78. The high pressure lubrication pump 79 operates in parallel with the low pressure lubrication pump 77. According to an embodiment, the lubrication fluid is provided to the high pressure inlet 78 at a rate in the range of 18-41 gallons per minute, for example approximately 37.5 gallons per minute. The high pressure lubrication pump 79 creates the higher lubrication fluid pressure of the high pressure lubrication circuit 100, as described further below. The high pressure lubrication fluid flows through a manifold, for example the input manifold 64, and is received by the crankshaft 36 such that it flows to each of the five crankshaft pins through a crankshaft pin conduit 75 associated with the crankshaft 36. Each crankshaft pin slides on a steel bushing that may be coated with lead, copper, or tin, or any combination of such materials. These sliding surfaces including the crankshaft pins and bushings are lubricated at high lubrication pressure. The flow rate of the lubrication fluid received by each of the pins of the crankshaft 36 may be in the range of 2-5 gallons per minute, for example approximately 4.3 gallons per minute. Similar to the gearbox 62 of the low pressure lubrication circuit 102, the lubrication fluid received by the crankshaft pin conduits 75 may pass through one or more orifice restrictors 91 to optimize the lubrication fluid flow rate and balance the temperatures of the lubrication fluid. The orifice restrictors 91 balance the flow in the lubrication circuits 100, 102 in order to maintain a substantially constant temperature of the lubrication fluid at the level of optimum lubrication effectiveness. According to one embodiment, the optimum lubrication fluid temperature is approximately 145° F.

The high pressure lubrication fluid also flows to each of the five crosshead bottom lubrication conduits 66 and is supplied to the sliding surfaces of the bottom portion 54 of the crosshead 44. The flow rate of the lubrication fluid received by each of the crosshead bottom conduits 66 may be in the range of 1-4 gallons per minute, for example 3.2 gallons per minute.

Similar to the low pressure lubrication circuit, the high pressure lubrication circuit also includes a manifold 86. According to certain embodiments, the manifold 86 includes a pressure relief valve 83, a lubrication fluid pressure gauge 85, and a temperature gauge 87.

A low pressure control valve that is fluidly coupled to the low pressure lubrication pump 77 maintains the lower lubrication pressure of the low pressure lubrication circuit 102. The low pressure control valve dumps the lubrication to the drain tank if the pressure on the valve exceeds a threshold value. Similarly, a high pressure control valve that is fluidly coupled to the high pressure lubrication pump 79 maintains the higher lubrication pressure of the high pressure lubrication circuit 100. The high pressure control valve allows accumulation of lubrication pressure in the high pressure circuit 100 to exceed the threshold value of the low pressure lubrication circuit 102 due to a higher setting on the high pressure control valve.

For example, the low pressure lubrication pump 77 maintains the lubrication fluid pressure at the outlets of the low pressure lubrication circuit 102 at approximately three atmospheres (45 psi), while the high pressure lubrication pump 79 creates higher lubrication pressure at the outlets of the high pressure lubrication circuit 100, which may, in some embodiments, be at least double that of the outlets of the low pressure lubrication circuit, and in certain embodiments may be triple the lubrication fluid pressure of the outlets of the low pressure lubrication circuit 102.

In an example, the low pressure lubrication circuit 102 operates at a lower pressure than the high pressure circuit 100. An example provides that the high pressure lubrication circuit 102 operates at a higher pressure than the low pressure circuit 102.

In the embodiment schematically illustrated by FIG. 3A, the high pressure lubrication pump 79 is mounted opposite the gearbox input 40 of the input flange 42, for example in the location of lubrication pump 58 (FIG. 2A). In this manner, the gearbox input 40 and the high pressure lubrication pump 79 are driven by the same shaft. In addition, in this position, the high pressure lubrication pump 79 is located closer to the lubrication fluid reservoir (not shown) such that less energy is required to draw the lubrication fluid from the reservoir than is required in conventional lubrication systems where the lubrication pump is located remote from the reciprocating pump 10 and is driven by the diesel engine. According to one embodiment, oil from the reservoir may travel 30% to 40% as far to reach a high pressure lubrication pump 79 than it does to reach a conventional single circuit lubrication pump disposed closer to the diesel engine. For example, the lubrication fluid may flow approximately 10 feet to reach a pump driven by the diesel engine, but may flow only approximately 3-4 feet to reach the high pressure lubrication pump 79. The lubrication fluid flows through a filter and a temperature control device before it reaches the high pressure pump 79.

According to one embodiment, a check valve 88 is disposed between the high pressure lubrication circuit and the low pressure lubrication circuit. The check valve 88 ensures that, if both the high pressure inlet 78 and the low pressure lubrication conduit 76 are receiving lubrication fluid, flow of the high pressure lubrication fluid is separated from the low pressure lubrication fluid to create the high and low pressure lubrication circuits 100 and 102. However, in certain reciprocating pump operations, such as hydraulic fracturing or fracking, the reciprocating pump 10 may not be pumping, but lubrication fluid may continue to flow through the lubrication system 16 at the low pressure. This is accomplished by delivering lubrication fluid to the lubrication system 16 by the low pressure lubrication conduit 76 and not the high pressure lubrication pump 79. Without the high pressure flow of lubrication acting on check valve 88, the low pressure lubrication flow overcomes the check valve 88 and allows the lubrication fluid at the low pressure to be received by the high pressure circuit 100 of the lubrication system 16. For example, a reciprocating pump 10 may be in neutral when the reciprocating pump 10 is not pumping because other operations are occurring with respect to fracking other than delivering high pressure fluid to the wellbore. With the reciprocating pump 10 in neutral, the high pressure lubrication pump is not being driven because the engine is not driving the gearbox input 40 and thus is not driving the high pressure lubrication pump 79. Nevertheless, the lubrication fluid may be pumped through the entire lubrication system 16 at the lower pressure with the low pressure lubrication pump 77. A second check valve 90 ensures that the fluid flow from the low pressure lubrication conduit 76 does not flow to the high pressure inlet 78 where it may cause damage to the non-operational portion of the high pressure lubrication pump 79.

According to an alternate embodiment, the dual circuit lubrication system 16 shown in FIG. 3A may be implemented without one or both of the check valves 88, 90. According to another alternate embodiment, the dual circuit lubrication system 16 may be fail safe. A valve (e.g., check valve, control valve, etc.) may be provided in a conduit that fluidly couples the low pressure lubrication circuit 102 to the high pressure lubrication circuit 100. If either the high pressure lubrication pump 79 or the low pressure lubrication pump 77 fails, the valve allows the operating pump to supply lubrication fluid to both the high pressure lubrication circuit 100 and the low pressure lubrication circuit 102.

Figure 3B:
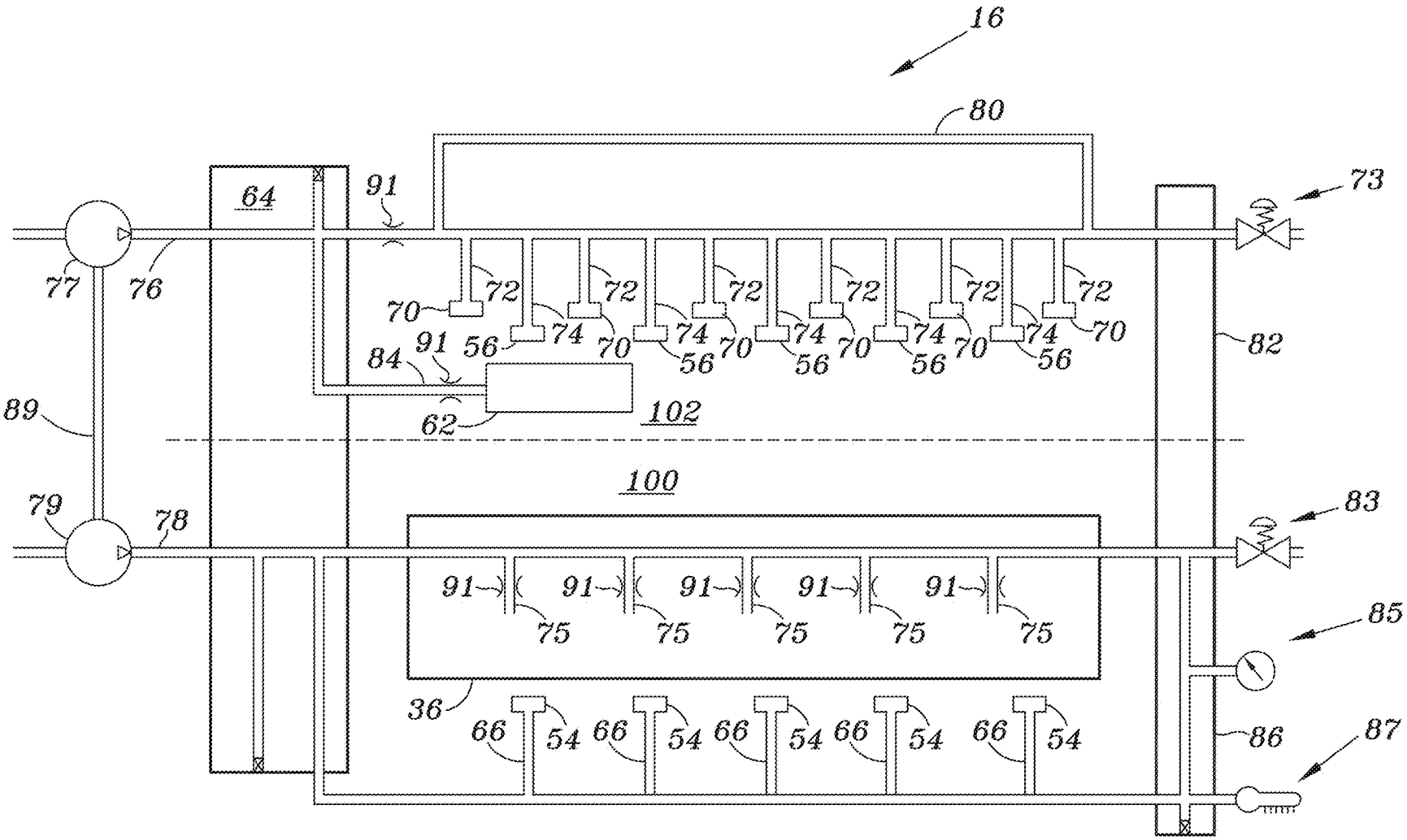

FIG. 3B illustrates an alternate embodiment of the dual circuit lubrication system 16 employing a high pressure lubrication pump 79 and a separate low pressure lubrication pump 77 where both pumps 77, 79 are driven by the drive shaft 89 from a diesel engine and are in parallel operation with each other. According to an alternate embodiment, the pumps 77, 79 may be driven independently of each other to completely separate the high pressure lubrication circuit 100 from the low pressure lubrication circuit 102. Regardless of whether the pumps 77, 79 are separately driven or driven by the same drive shaft 89, the high pressure lubrication circuit 100 is supplied by the high pressure lubrication pump 79, and the low pressure lubrication circuit 102 is supplied by the low pressure lubrication pump 77. Both pumps 77, 79 pump lubrication fluid to the power end 14 of the reciprocating pump 10 when the diesel engine is running, regardless whether the transmission is engaged to reciprocate the plungers 28. Enumerated components of the embodiment depicted in FIG. 3B that are not explicitly described can function the same as or substantially similar to and can have the same or substantially the same characteristics as the similarly enumerated components of the embodiment depicted in FIG. 3A.

Figure 3C:
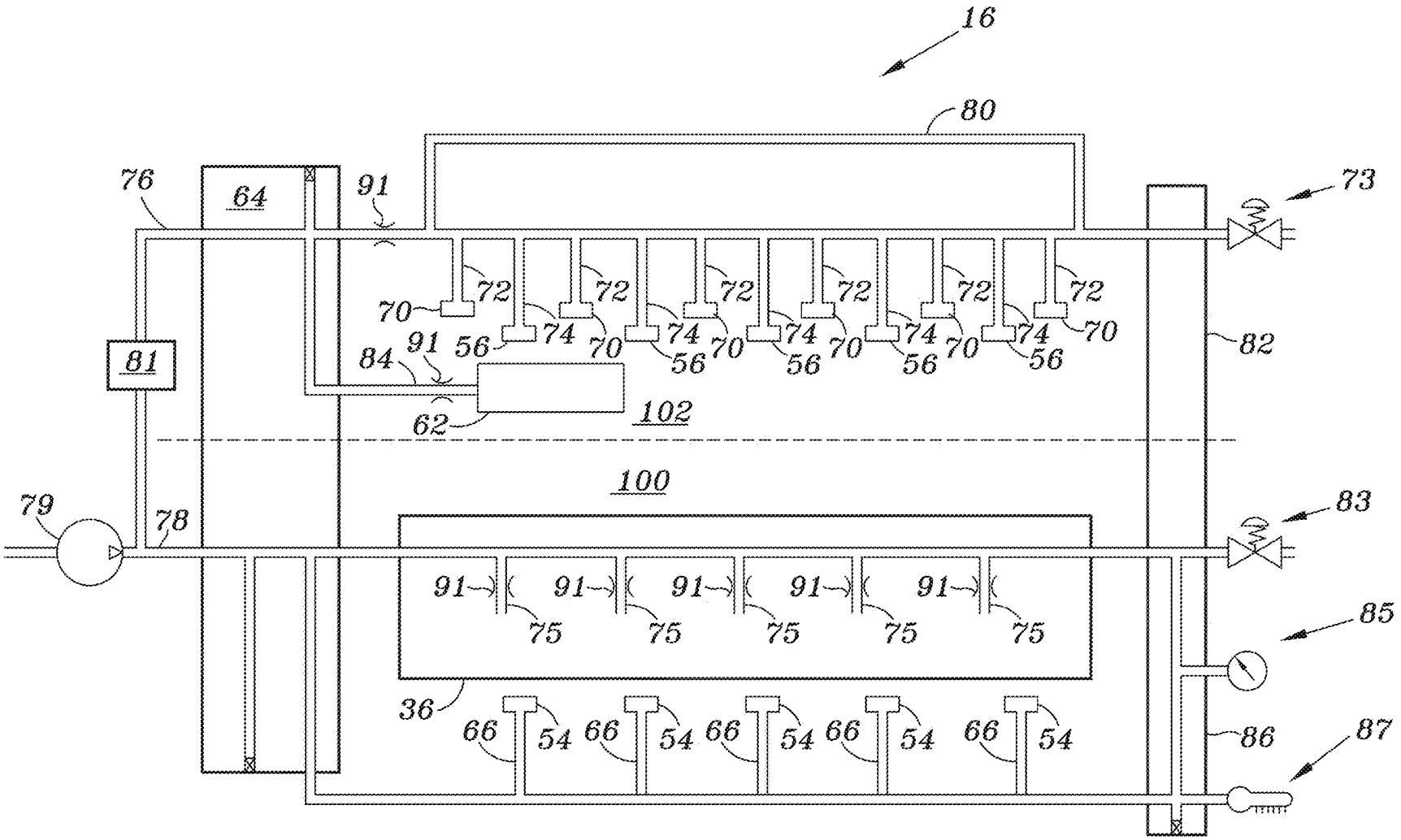

FIG. 3C illustrates yet another alternate embodiment of the dual circuit lubrication system 16 employing a single high pressure lubrication pump 79 that supplies lubrication fluid to both the low pressure lubrication circuit 102 and the high pressure lubrication circuit 100. A pressure compensating valve 81 creates the low lubrication pressure by draining lubrication fluid pumped by the high pressure lubrication pump 79 through the lubrication system 16 and to the reservoir to create the low lubrication pressure of the low pressure lubrication circuit 102. Enumerated components of the embodiment depicted in FIG. 3C that are not explicitly described can function the same as or substantially similar to and can have the same or substantially the same characteristics as the similarly enumerated components of the embodiment depicted in FIG. 3A.

Figure 3D:
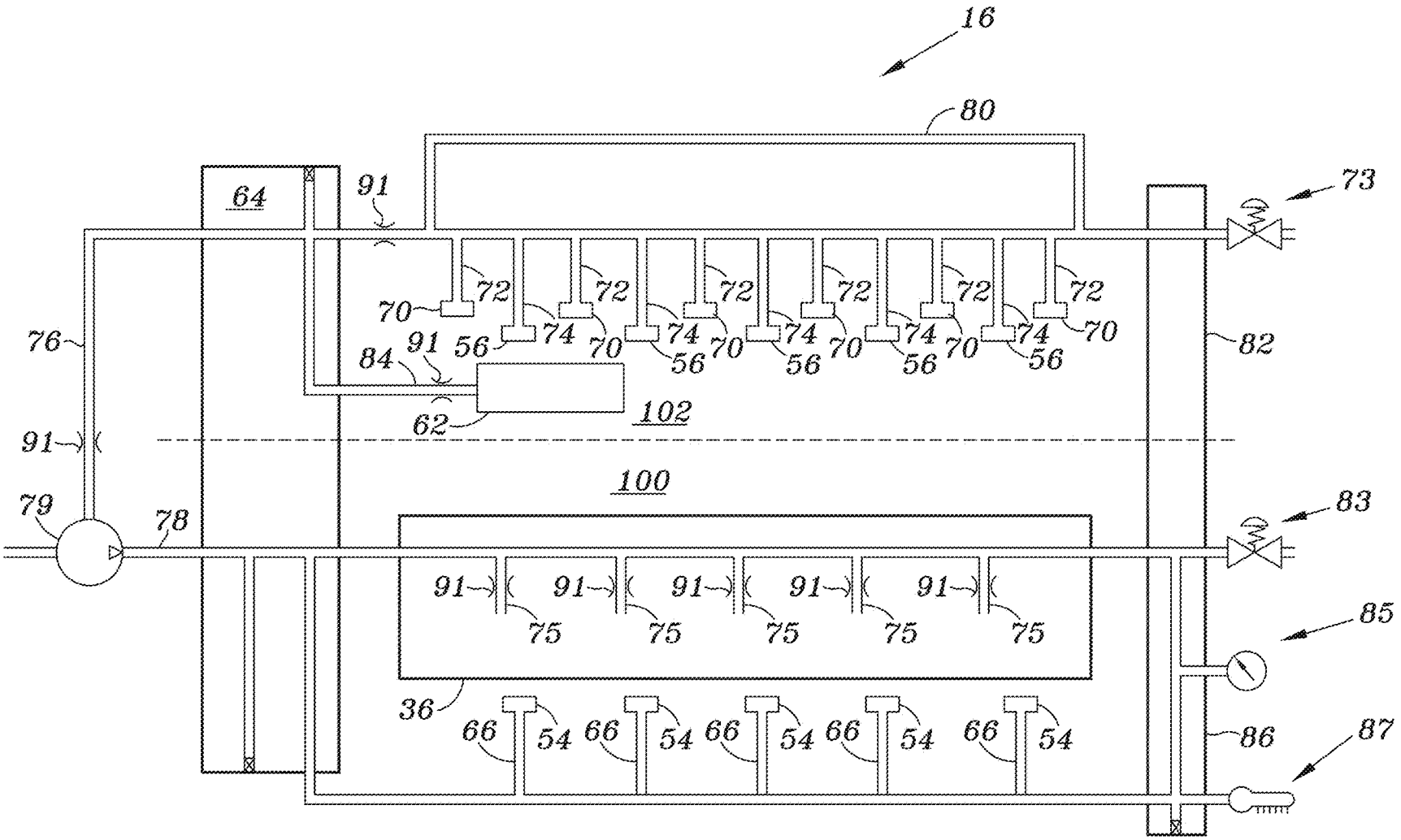

FIG. 3D illustrates yet another embodiment of the dual circuit lubrication system 16 employing a single lubrication pump 79 that is fluidly coupled to both the low pressure lubrication conduit 76 and the high pressure lubrication conduit 78. The lubrication pump 79 is operable to deliver a flow of lubrication fluid at the lubrication fluid pressure of the low pressure lubrication circuit 102 and the lubrication fluid pressure of the high pressure lubrication circuit 100 (e.g., with two outlets operable to supply the corresponding low or high pressure lubrication fluid). In this embodiment, an orifice restrictor 91 reduces the flow rate to the low pressure lubrication circuit 102 and thereby produces the higher pressure in high pressure lubrication circuit 100. Enumerated components of the embodiment depicted in FIG. 3D that are not explicitly described can function the same as or substantially similar to and can have the same or substantially the same characteristics as the similarly enumerated components of the embodiment depicted in FIG. 3A.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Directional terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A reciprocating pump, comprising:

at least one plunger configured for reciprocating movement in a plunger bore;

a crankshaft coupled to and configured to drive the at least one plunger, the crankshaft having a plurality of journal surfaces;

at least one crosshead operatively coupled to the at least one plunger;

one or more lubrication pumps configured to supply a lubrication fluid to a high pressure lubrication circuit and a low pressure lubrication circuit;

the high pressure lubrication circuit being fluidly coupled to supply at least some of the lubrication fluid to the plurality of journal surfaces associated with the crankshaft at a first lubrication fluid pressure and to supply the lubrication fluid to a bottom portion of the at least one crosshead at the first lubrication fluid pressure; and the low pressure lubrication circuit being fluidly coupled to supply at least some of the lubrication fluid to a plurality of roller bearing surfaces associated with the crankshaft at a second lubrication fluid pressure, the first lubrication fluid pressure being greater than the second lubrication fluid pressure.

2. The reciprocating pump of claim 1, wherein the first lubrication fluid pressure is at least 1.5 times the second lubrication fluid pressure.

3. The reciprocating pump of claim 1, wherein the low pressure lubrication circuit supplies at least some of the lubrication fluid to a top portion of the at least one crosshead.

4. The reciprocating pump of claim 1, wherein the low pressure lubrication circuit supplies at least some of the lubrication fluid to a gearbox associated with the reciprocating pump.

5. The reciprocating pump of claim 1, wherein the one or more lubrication pumps comprises a high pressure lubrication pump being fluidly coupled to the high pressure lubrication circuit and a separate low pressure lubrication pump being fluidly coupled to the low pressure lubrication circuit.

6. The reciprocating pump of claim 1, wherein the at least one plunger comprises at least three plungers and the at least one crosshead comprises at least three crossheads and the crankshaft drives the at least three crossheads, each crosshead coupled to a respective one of the at least three plungers.

7. The reciprocating pump of claim 1, wherein the at least one plunger comprises at least five plungers and the at least one crosshead comprises at least five crossheads and the crankshaft drives the at least five crossheads, each crosshead coupled to a respective one of the at least five plungers.

8. The reciprocating pump of claim 1, wherein the one or more lubrication pumps are gear-type pumps.

9. The reciprocating pump of claim 1, wherein the at least one crosshead is configured to move within a crosshead housing and a bushing is disposed between the at least one crosshead and the crosshead housing, the high pressure lubrication circuit being configured to provide the lubrication fluid between the at least one crosshead and the bushing.

10. The reciprocating pump of claim 1 further comprising at least one check valve fluidly coupled between the high pressure lubrication circuit and the low pressure lubrication circuit, the at least one check valve configured to allow circulation of the lubrication fluid at the second lubrication fluid pressure while the reciprocating pump is in neutral and circulation of the lubrication fluid at both the second and the first lubrication fluid pressures when the reciprocating pump is pumping.

11. The reciprocating pump of claim 1, further comprising a connecting rod coupled to the crankshaft at a first end and a knuckle bearing and a wrist pin at a second end, the knuckle bearing and the wrist pin configured to receive at least some of the lubrication fluid from the low pressure lubrication circuit without a lubrication conduit through the connecting rod.

12. The reciprocating pump of claim 11 wherein a bushing associated with a crankshaft pin is not fluidly coupled to the knuckle bearing.

13. A reciprocating pump with a dual circuit lubrication system, comprising:

a plurality of plungers configured for reciprocating movement in respective plunger bores;

a crankshaft coupled to and configured to drive the plurality of plungers, the crankshaft having a plurality of journal surfaces;

a plurality of crossheads each operatively coupled to a respective one of the plurality of plungers;

one or more lubrication pumps configured to supply a lubrication fluid to a high pressure lubrication circuit and a low pressure lubrication circuit;

the high pressure lubrication circuit being fluidly coupled to supply at least some of the lubrication fluid to the plurality of journal surfaces associated with the crankshaft and to a bottom portion of each of the plurality of crossheads at a first lubrication fluid pressure; and the low pressure lubrication circuit being fluidly coupled to supply at least some of the lubrication fluid to a plurality of roller bearing surfaces associated with the crankshaft and to a top portion of each of the plurality of crossheads at a second lubrication fluid pressure, the first lubrication fluid pressure being greater than the second lubrication fluid pressure.

14. The reciprocating pump of claim 13, wherein the first lubrication fluid pressure is at least 1.5 times the second lubrication fluid pressure.

15. The reciprocating pump of claim 13, wherein the low pressure lubrication circuit supplies the lubrication fluid to a gearbox configured to provide input to the crankshaft.

16. The reciprocating pump of claim 13, further comprising at least one pressure control valve configured to maintain the lubrication fluid in the low pressure lubrication circuit at the second lubrication fluid pressure.

17. The reciprocating pump of claim 13, further comprising at least one check valve fluidly coupled between the high pressure lubrication circuit and the low pressure lubrication circuit, the at least one check valve allowing recirculation of the lubrication fluid at the second lubrication fluid pressure in the low pressure lubrication circuit while the reciprocating pump is in neutral, and allowing recirculation of the lubrication fluid at the second lubrication fluid pressure in the low pressure lubrication circuit and recirculation of the lubrication fluid at the first lubrication fluid pressure in the high pressure lubrication circuit when the reciprocating pump is pumping.

18. A reciprocating pump with a dual circuit lubrication system, comprising:

a plurality of plungers configured for reciprocating movement in respective plunger bores;

a crankshaft coupled to and configured to drive the plurality of plungers, the crankshaft having a plurality of journal surfaces;

a plurality of crossheads each operatively coupled to a respective one of the plurality of plungers;

one or more lubrication pumps configured to supply a lubrication fluid to a high pressure lubrication circuit and a low pressure lubrication circuit;

the high pressure lubrication circuit being fluidly coupled to supply at least some of the lubrication fluid to the plurality of journal surfaces associated with the crankshaft and to the plurality of crossheads, the high pressure lubrication circuit receiving the lubrication fluid at a first lubrication fluid pressure and a first flow rate;

the low pressure lubrication circuit being fluidly coupled to supply the lubrication fluid to a plurality of roller bearing surfaces associated with the crankshaft, the low pressure lubrication circuit receiving the lubrication fluid at a second lubrication fluid pressure and a second flow rate;

the first lubrication fluid pressure being 80-120 pounds per square inch and the first flow rate being 18-41 gallons per minute; and the second lubrication fluid pressure being 35-65 pounds per square inch and the second flow rate being 18-41 gallons per minute, wherein the low pressure lubrication circuit supplies the lubrication fluid to a top portion of each of the plurality of crossheads, and the high pressure lubrication circuit supplies the lubrication fluid to a bottom portion of each of the plurality of crossheads.

19. The reciprocating pump of claim 18, wherein the first lubrication fluid pressure is at least 1.5 times the second lubrication fluid pressure.

20. A reciprocating pump, comprising:

at least one plunger configured for reciprocating movement in a plunger bore;

a crankshaft coupled to and configured to drive the at least one plunger, the crankshaft having a plurality of journal surfaces;

a connecting rod coupled to the crankshaft at a first end and contacting a knuckle bearing at a second end;

one or more lubrication pumps configured to supply a lubrication fluid to a high pressure lubrication circuit and a low pressure lubrication circuit;

the high pressure lubrication circuit being fluidly coupled to supply at least some of the lubrication fluid to the plurality of journal surfaces associated with the crankshaft at a first lubrication fluid pressure; and the low pressure lubrication circuit being fluidly coupled to supply at least some of the lubrication fluid to a plurality of roller bearing surfaces associated with the crankshaft and to the knuckle bearing at a second lubrication fluid pressure, wherein the first lubrication fluid pressure is greater than the second lubrication fluid pressure, and the lubrication fluid is provided to the knuckle bearing without a lubrication conduit through the connecting rod.

21. The reciprocating pump of claim 20 further comprising:

a wrist pin at the second end of the connecting rod, wherein the wrist pin is configured to receive at least some of the lubrication fluid from the low pressure lubrication circuit.

* * * * *